US011958674B2

(12) United States Patent
Gil

(10) Patent No.: US 11,958,674 B2
(45) Date of Patent: Apr. 16, 2024

(54) ITEM STORAGE UNIT FOR STORING ONE OR MORE ITEMS

(71) Applicant: United Parcel Service of America, Inc., Atlanta, GA (US)

(72) Inventor: Julio Gil, Veldhoven (NL)

(73) Assignee: United Parcel Service of America, Inc., Atlanta, GA (US)

( * ) Notice: Subject to any disclaimer, the term of this patent is extended or adjusted under 35 U.S.C. 154(b) by 0 days.

(21) Appl. No.: 17/136,127

(22) Filed: Dec. 29, 2020

(65) Prior Publication Data

US 2022/0204233 A1 Jun. 30, 2022

(51) Int. Cl.
*B65D 75/32* (2006.01)
*B65D 75/00* (2006.01)

(52) U.S. Cl.
CPC ..... *B65D 75/322* (2013.01); *B65D 75/006* (2013.01); *B65D 75/323* (2013.01); *B65D 2203/06* (2013.01); *B65D 2575/329* (2013.01)

(58) Field of Classification Search
CPC .... B65D 81/07; B65D 81/075; B65D 5/0085; B65D 5/50; B65D 5/5028; B65D 5/58; B65D 5/603; B65D 25/102; B65D 63/00; B65D 75/00; B65D 75/006; B65D 75/04; B65D 81/02; B65D 81/05
USPC ..... 206/467, 583, 806
See application file for complete search history.

(56) References Cited

U.S. PATENT DOCUMENTS 1,664,477 A * 4/1928 Hunzelman ..... B65D 81/02 217/5
1,792,715 A * 2/1931 Steinharter ..... B65D 81/07 206/419
2,889,920 A * 6/1959 Andress ..... A01G 5/00 47/84
3,359,889 A * 12/1967 Young ..... A47J 37/049 99/426
5,218,510 A * 6/1993 Bradford ..... H05F 1/00 206/583
5,386,911 A 2/1995 Payne
6,513,658 B1 * 2/2003 Adkins ..... B65D 81/052 206/583
7,395,931 B2 * 7/2008 Gillis ..... B65D 81/075 206/583
8,047,378 B2 * 11/2011 Eskenazi ..... B65D 43/162 206/594

(Continued)

FOREIGN PATENT DOCUMENTS

WO 98/42589 A1 10/1998
WO 2019/224281 A2 11/2019

OTHER PUBLICATIONS

International Search Report and Written Opinion received for PCT Patent Application No. PCT/US2021/055205, dated Feb. 23, 2022, 14 pages.

*Primary Examiner* — Robert Poon

(74) *Attorney, Agent, or Firm* — Shook, Hardy & Bacon L.L.P.

(57) ABSTRACT

In some aspects, an item storage unit for storing one or more items includes the following components. A first frame component and a first stretch member coupled to at least a first surface of the first frame component. The first stretch member being more flexible relative to the first frame component. The one or more items are configured to be supported by at least the first stretch member and the first frame component.

20 Claims, 13 Drawing Sheets

(56) References Cited

U.S. PATENT DOCUMENTS

| | | | | |
|---|---|---|---|---|
| 11,731,824 | B2 * | 8/2023 | Cotte | B65D 25/102 206/583 |
| 2005/0011807 | A1 * | 1/2005 | Dennison | B65D 5/5028 206/583 |
| 2005/0121354 | A1 * | 6/2005 | Gillis | G11B 33/08 206/583 |
| 2006/0042995 | A1 * | 3/2006 | McGrath | B65D 43/162 206/583 |
| 2009/0314674 | A1 * | 12/2009 | Sauerheber | B25H 3/021 206/373 |
| 2010/0012653 | A1 * | 1/2010 | Ulrich | B65D 81/3825 220/1.5 |
| 2015/0266642 | A1 | 9/2015 | Mcdonald et al. | |
| 2019/0359377 | A1 * | 11/2019 | Bretz | B65B 61/22 |

* cited by examiner

ITEM STORAGE UNIT FOR STORING ONE OR MORE ITEMS

BACKGROUND

In the shipping industry, items are typically packaged and delivered in cardboard or corrugated parcels. Around eighty percent of all sold items are packaged in some type of cardboard. Although cardboard may be recycled, a growing number of cities are not recycling given the rising recycling costs. Accordingly, cardboard parcels are often disposed of in landfills or incinerators, which are associated with producing pollutants, toxins, or greenhouse gasses.

Moreover, shipping parcels are typically inefficient for storage, both in terms of how items are stored inside of the parcel, and how the parcel itself is stored. For example, cardboard parcels tend to have lots of open space between the items they carry and the cardboard parcels themselves. This not only wastes cardboard resources, but can cause the items to shift or slide, thereby causing breakage or other damage to the items. In another example, cardboard parcels can take up a lot of space in a carrier vehicles, logistics stores, or sorting centers, especially when taking into account the relatively smaller size of the actual items inside of the parcels.

SUMMARY

This summary is provided to introduce a selection of concepts in a simplified form that are further described below in the detailed description. This summary is not intended to identify key features or essential features of the claimed subject matter, nor is it intended to be used in isolation as an aid in determining the scope of the claimed subject matter. Further, alternative or additional embodiments exist other than those described in this summary section.

Some embodiments are directed to an item storage unit for storing one or more items, where the item storage unit comprises the following components. A first frame component and a first stretch member coupled to at least a first surface of the first frame component. The first stretch member having a greater stretching capacity relative to the first frame component. The item storage unit further comprises a joint component coupled to a second surface of the first frame component. The joint component is further coupled to a third surface of a second frame component. The joint component allows rotation of the first frame component and the second frame component. The item storage unit may further include a second stretch member coupled to at least a fourth surface of the second frame component. The one or more items are configured to be situated between the first stretch member and the second stretch member.

Some embodiments are directed to an item storage unit for storing one or more items, where the item storage unit comprises the following components. A first frame component and a first stretch member coupled to at least a first surface of the first frame component. The first stretch member being more flexible relative to the first frame component. The one or more items are configured to be supported by at least the first stretch member and the first frame component.

Some embodiments are directed to a system that includes an item storage unit that includes a first frame component and a first stretch member coupled to at least a first surface of the first frame component. The first stretch member having a greater stretching capacity relative to the first frame component. In some embodiments, the system further comprises one or more items included in the item storage unit. At least a portion of the first stretch member may conform to at least a portion of the one or more items. The one or more items are requested for shipment. In some embodiments, the system includes a holding apparatus that stores the item storage unit. Some embodiments are directed to a holding apparatus itself.

BRIEF DESCRIPTION OF THE DRAWINGS

Figure 1:
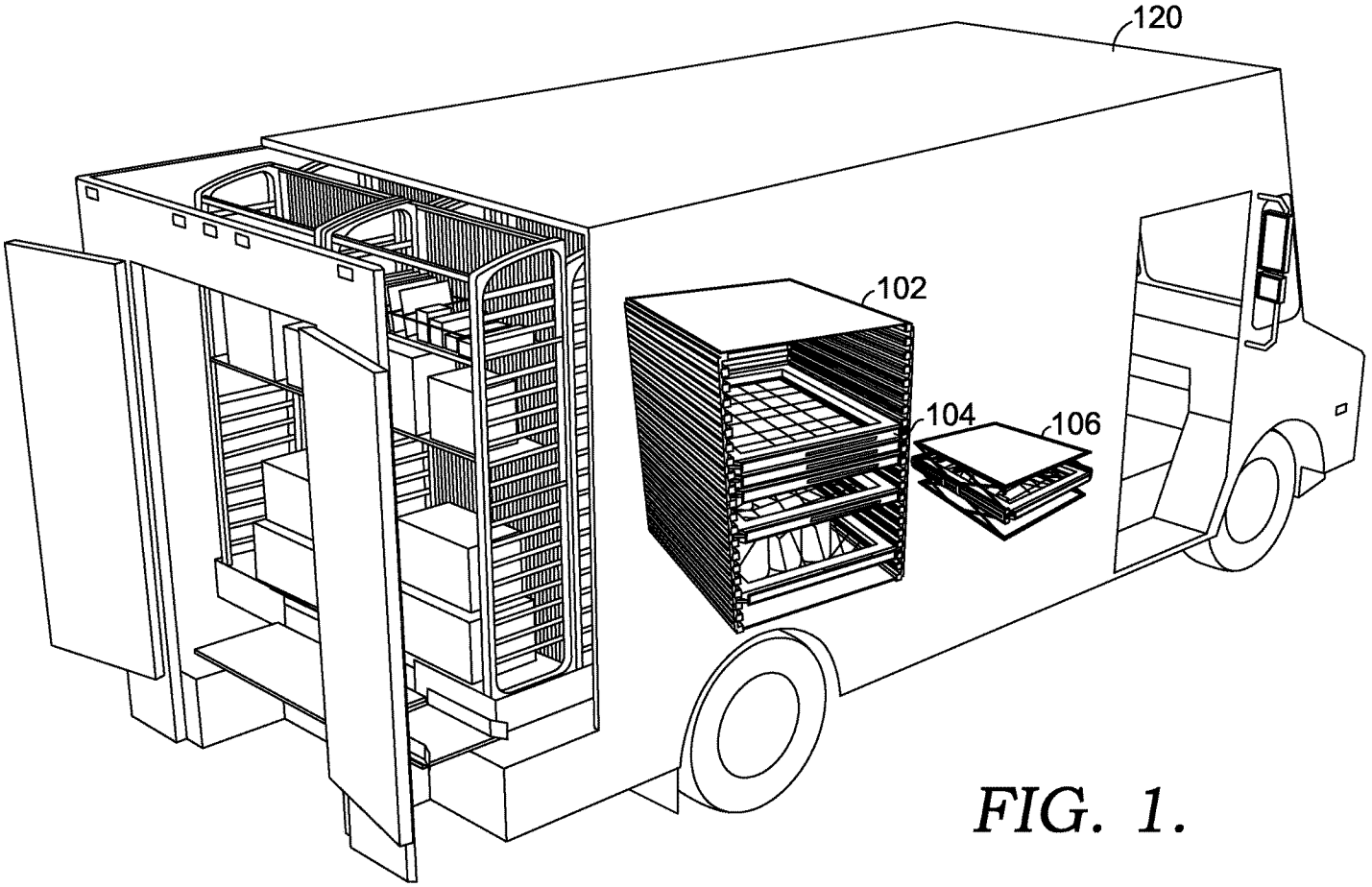
Figure 2:
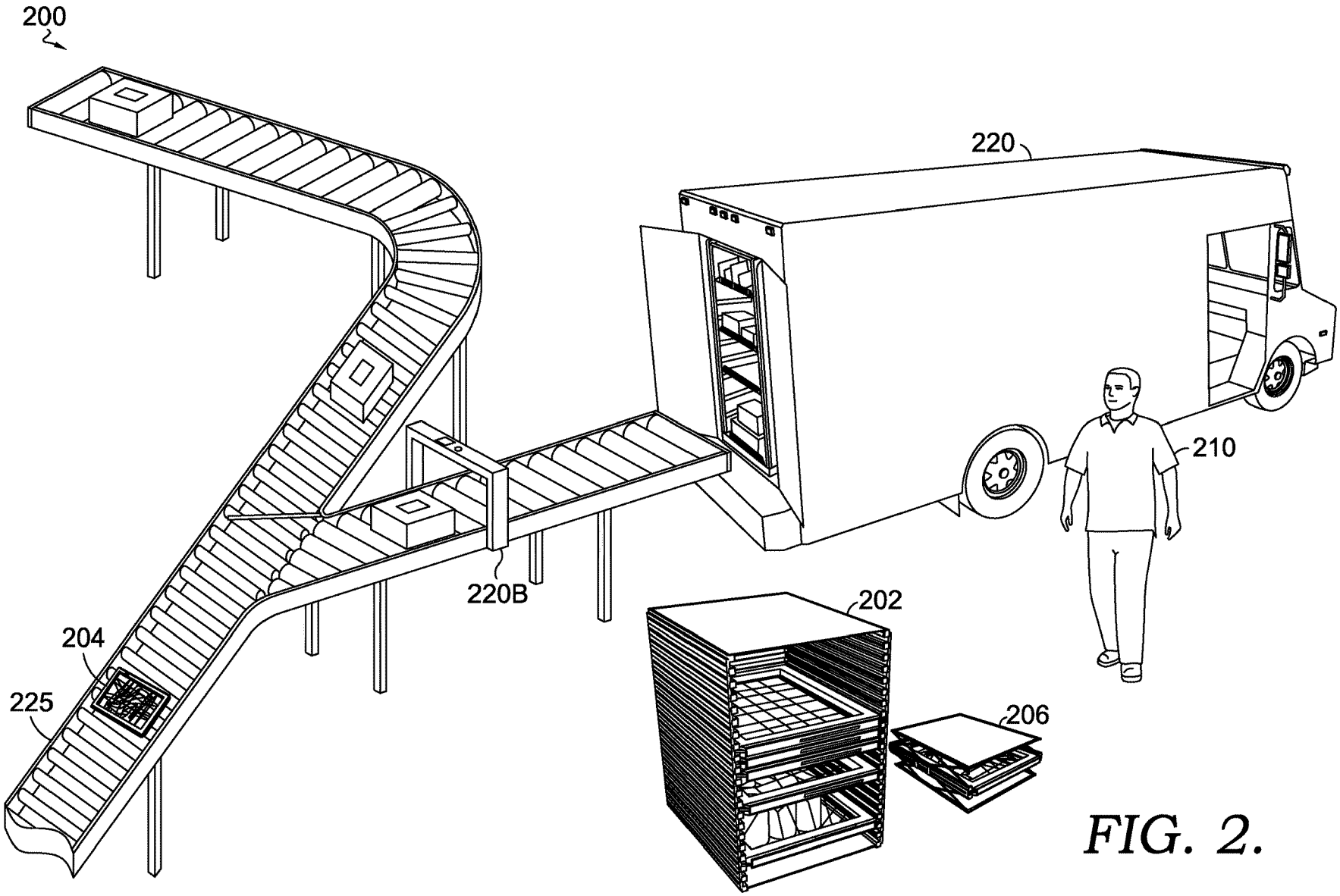
Figure 3A:
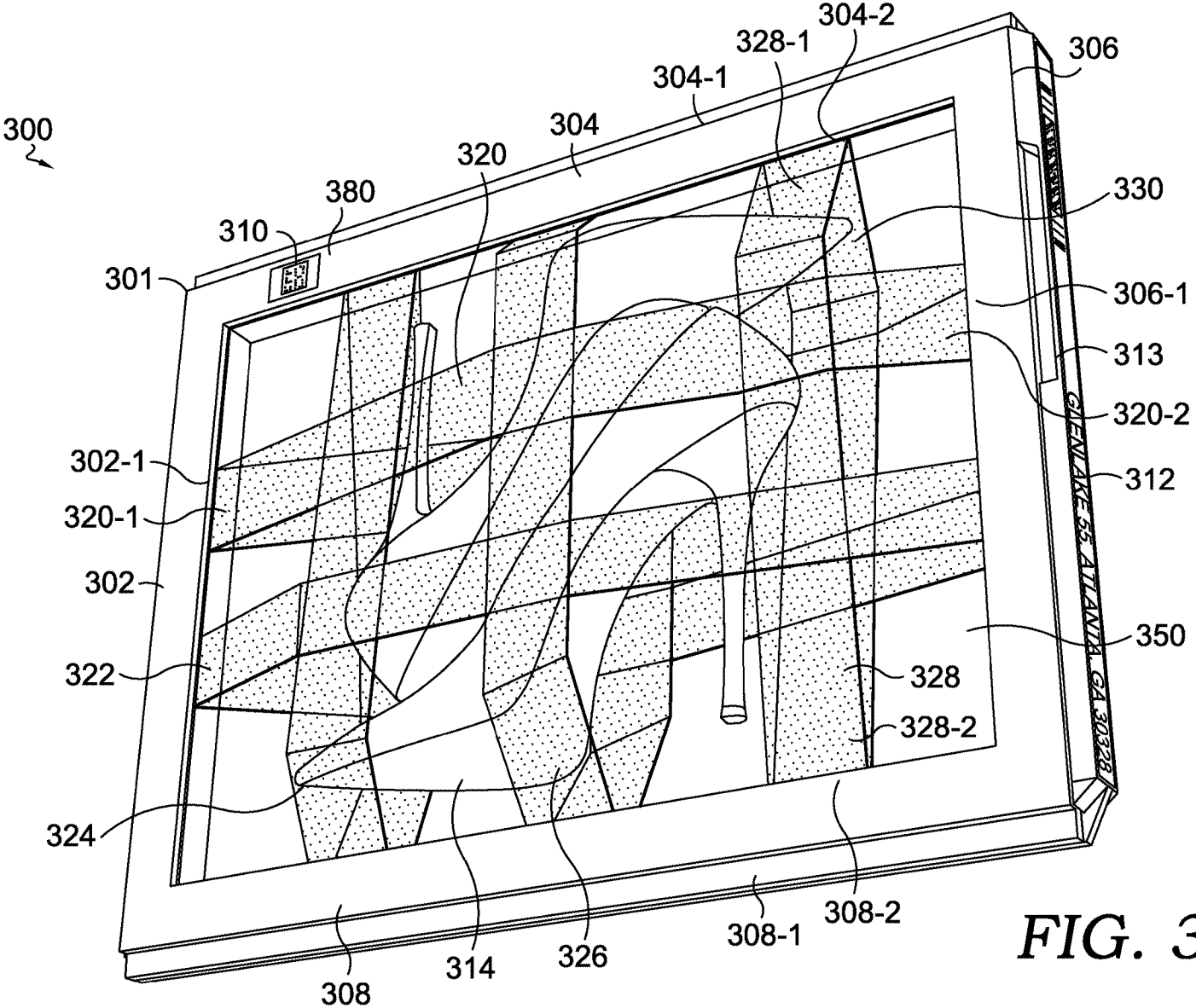
Figure 3B:
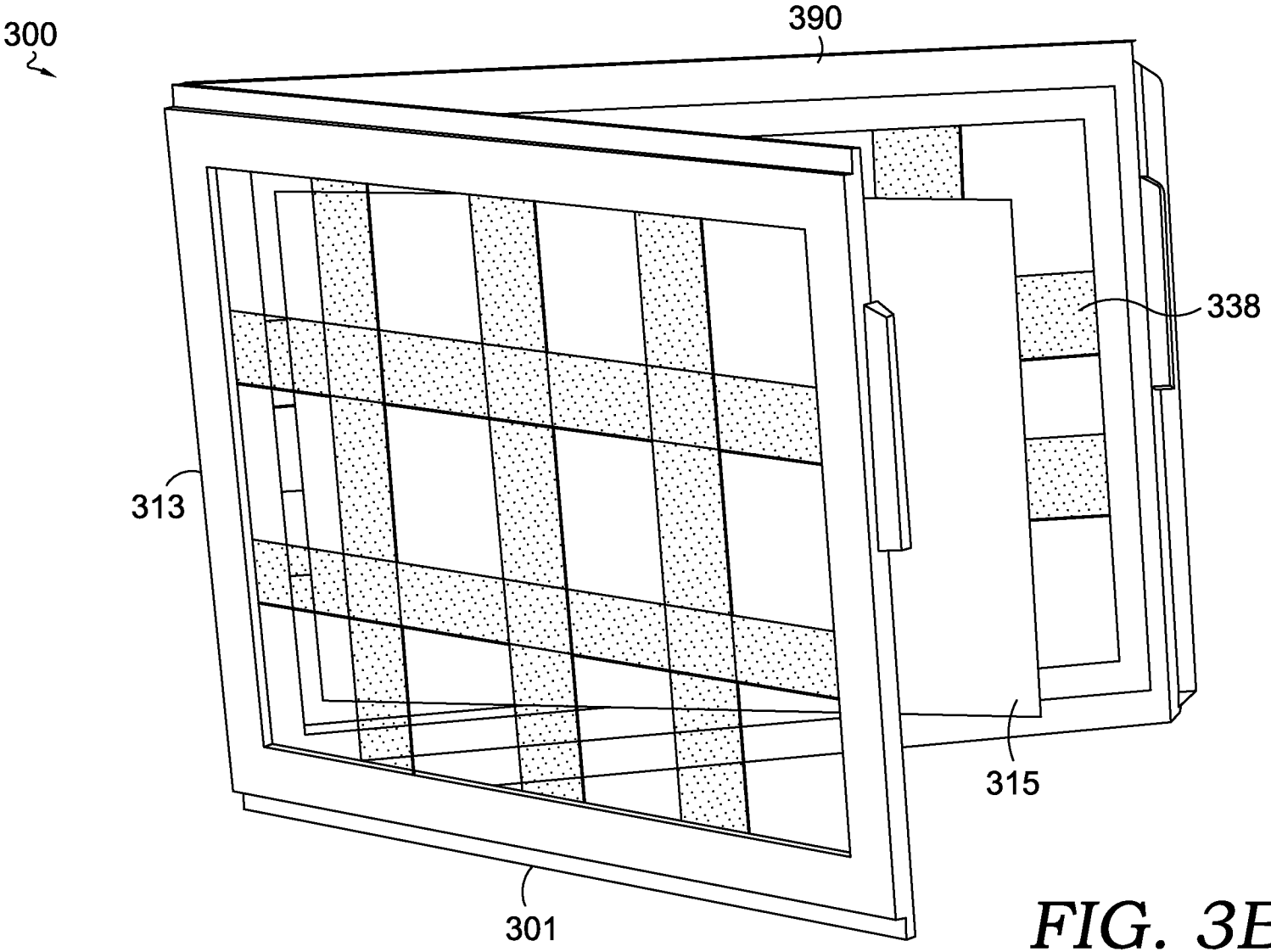
Figure 3C:
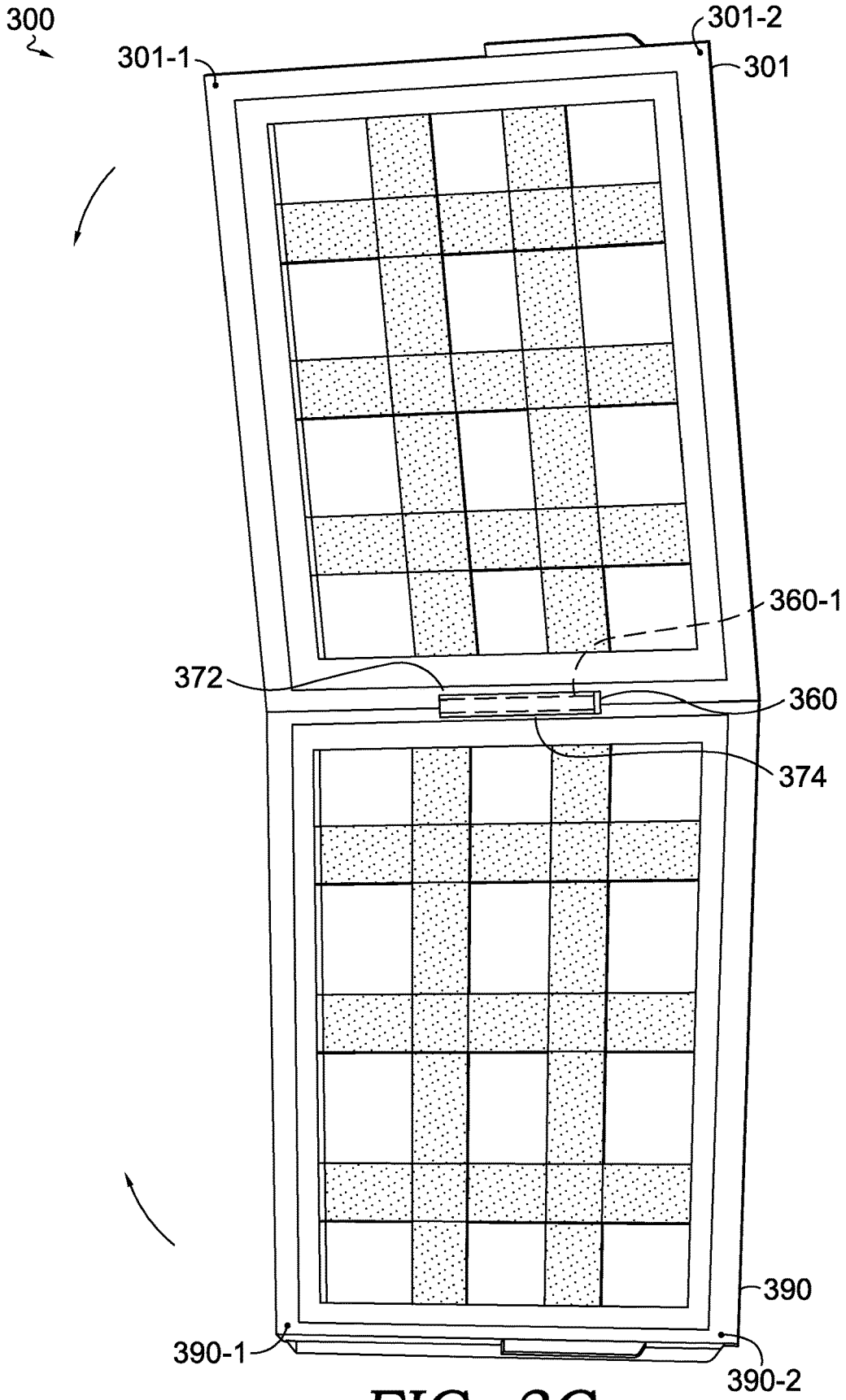
Figure 3D:
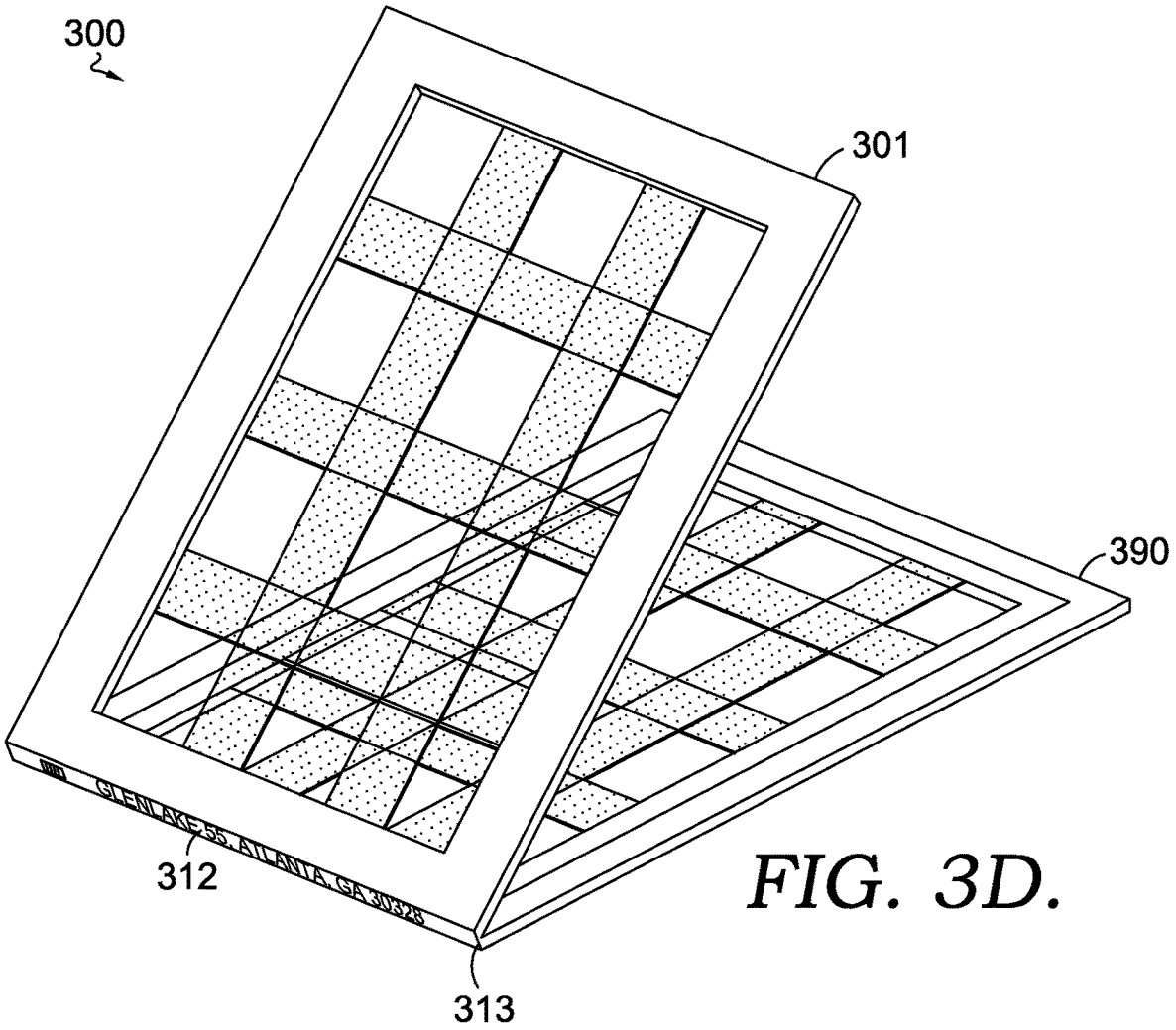
Figure 3E:
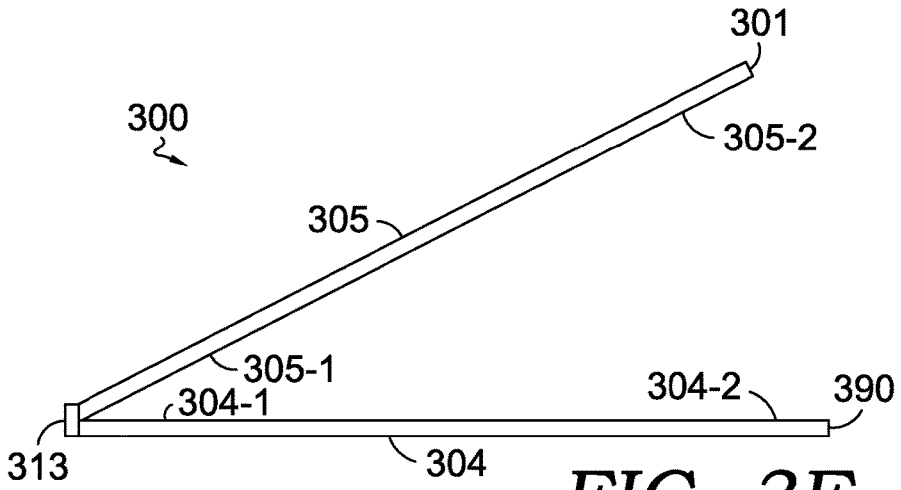
Figure 3F:
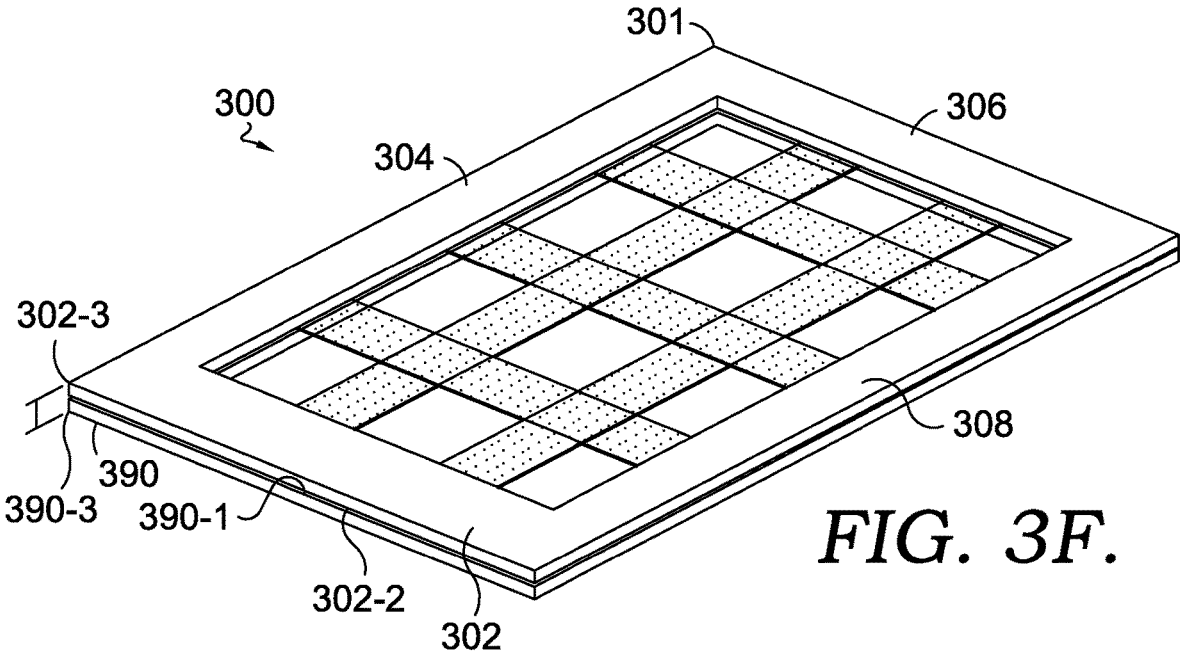
Figure 3G:
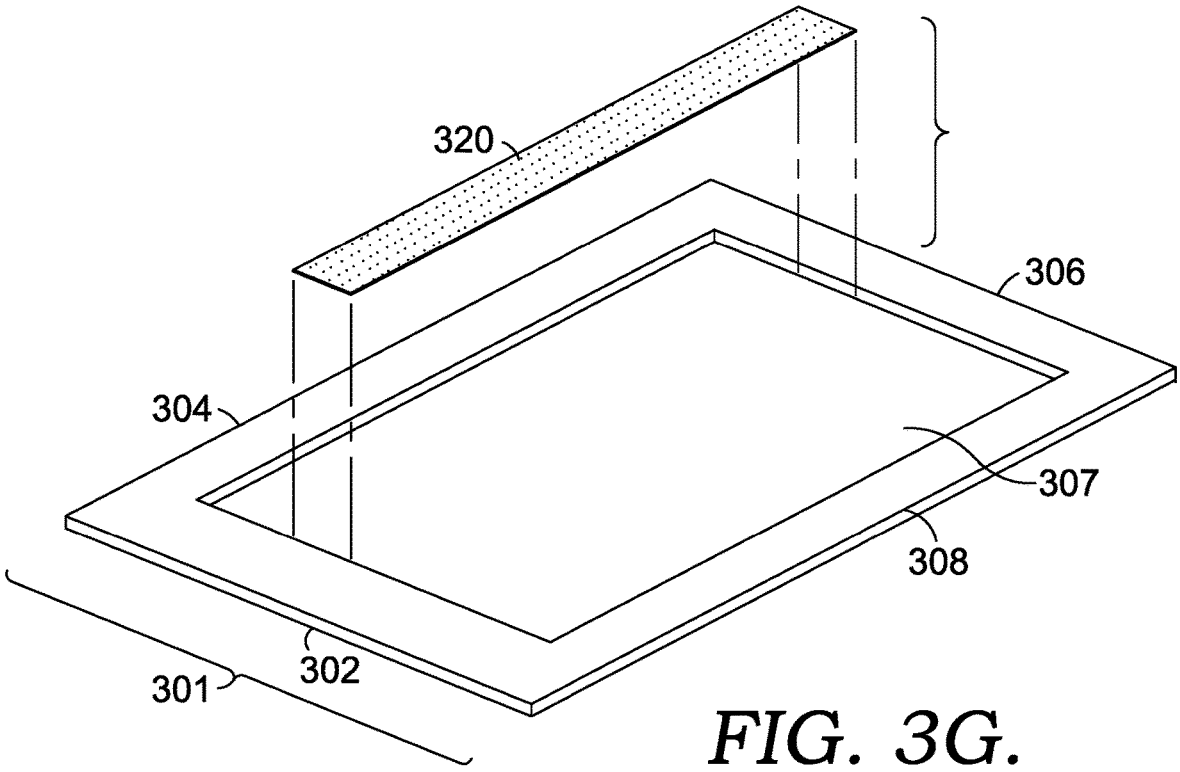
Figure 4:
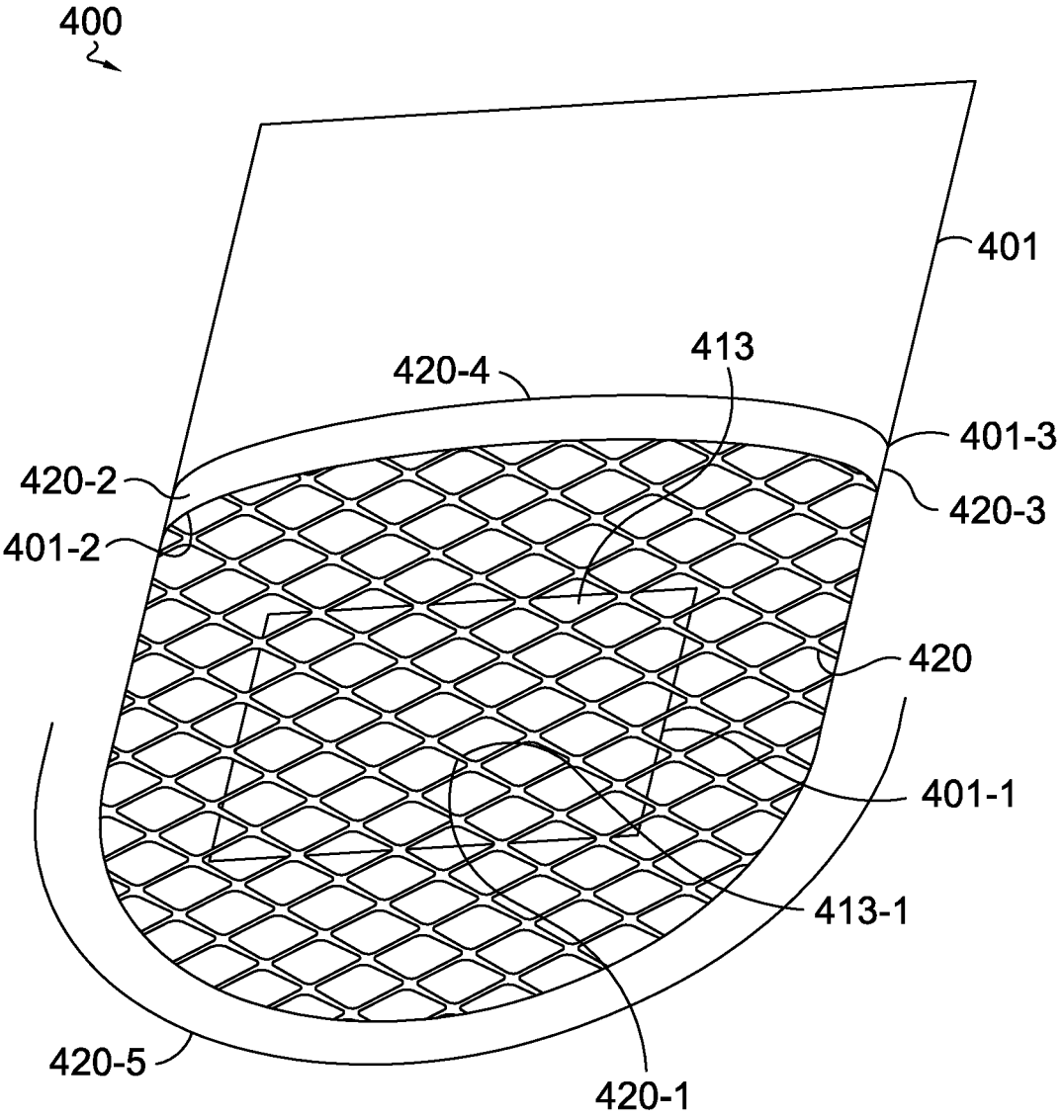
Figure 5A:
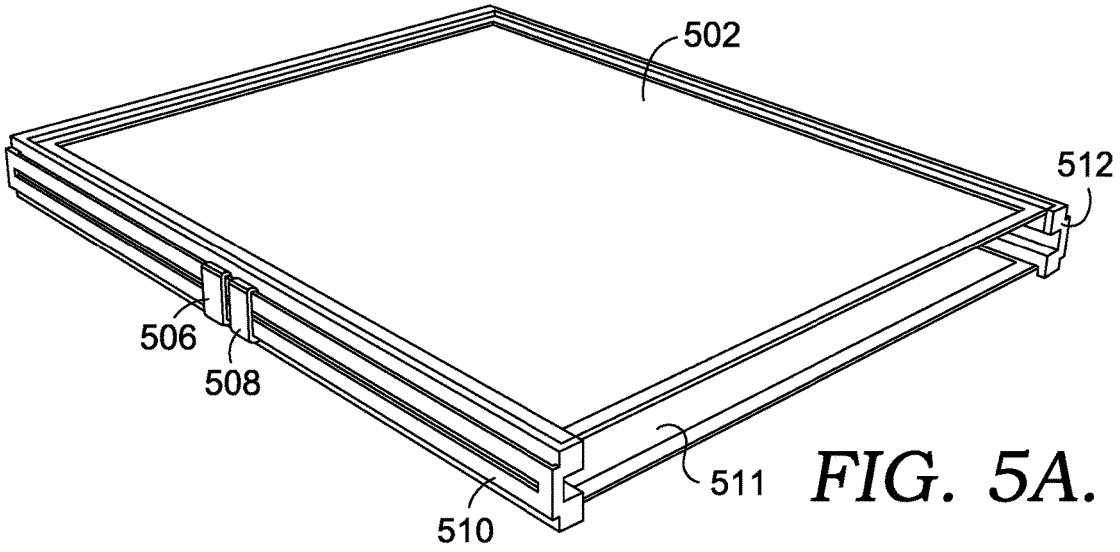
Figure 5B:
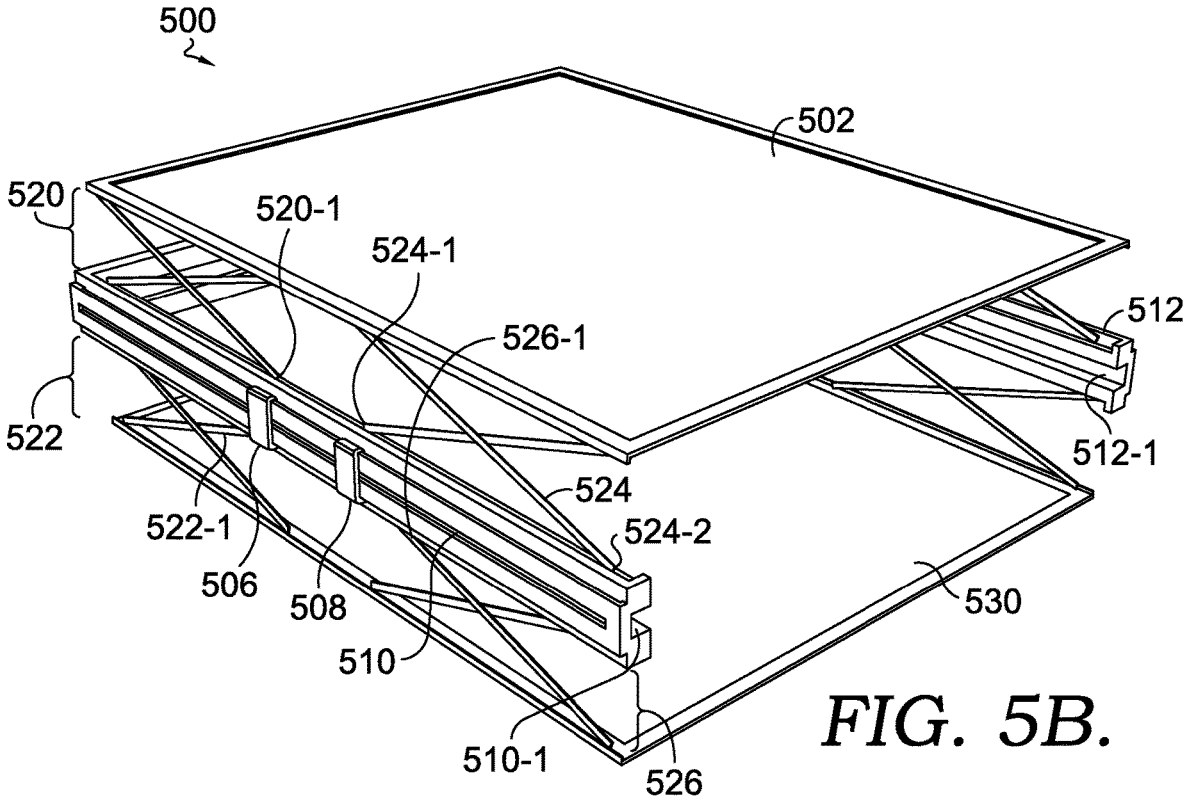
Figure 5C:
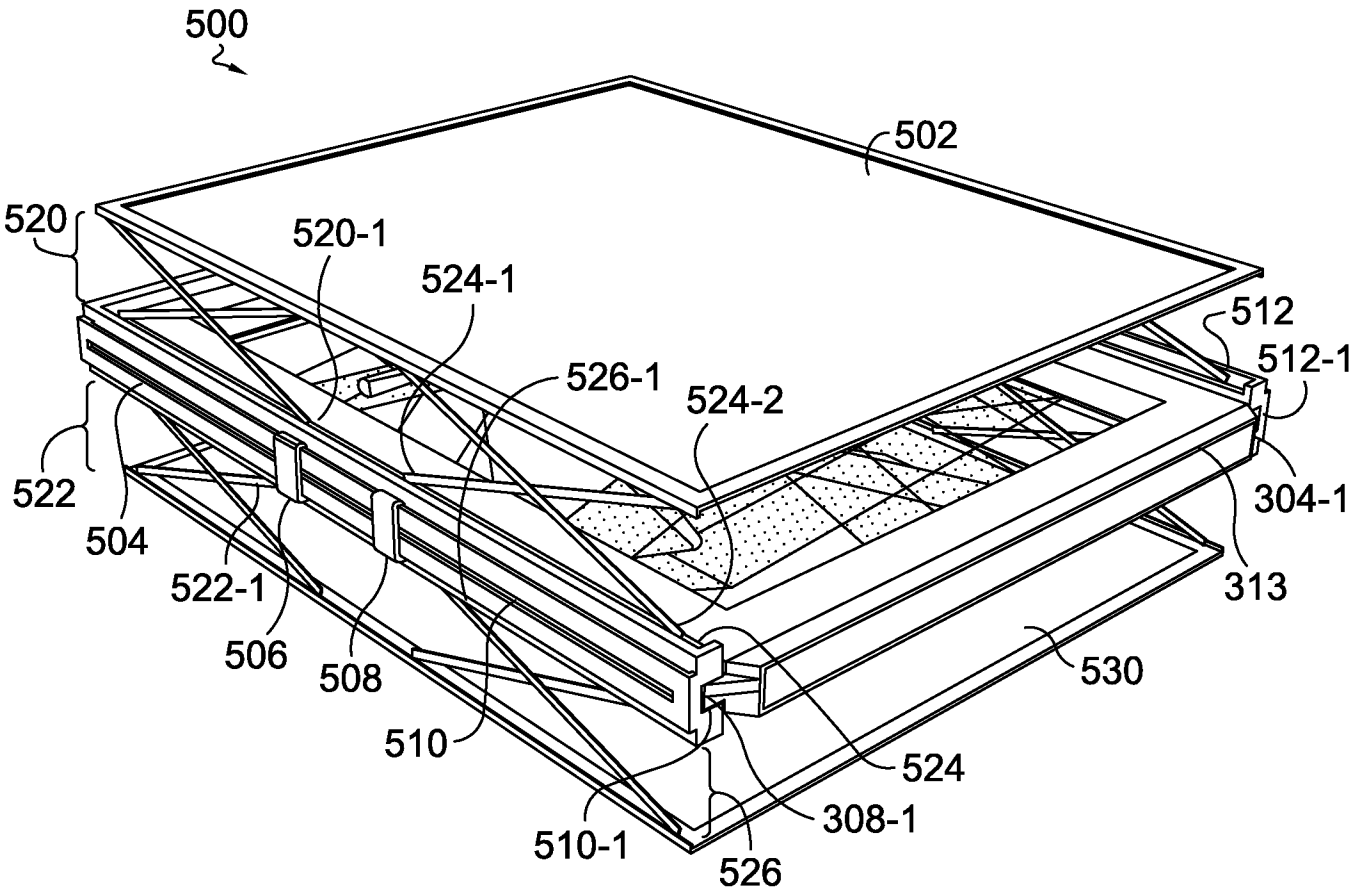
Figure 6A:
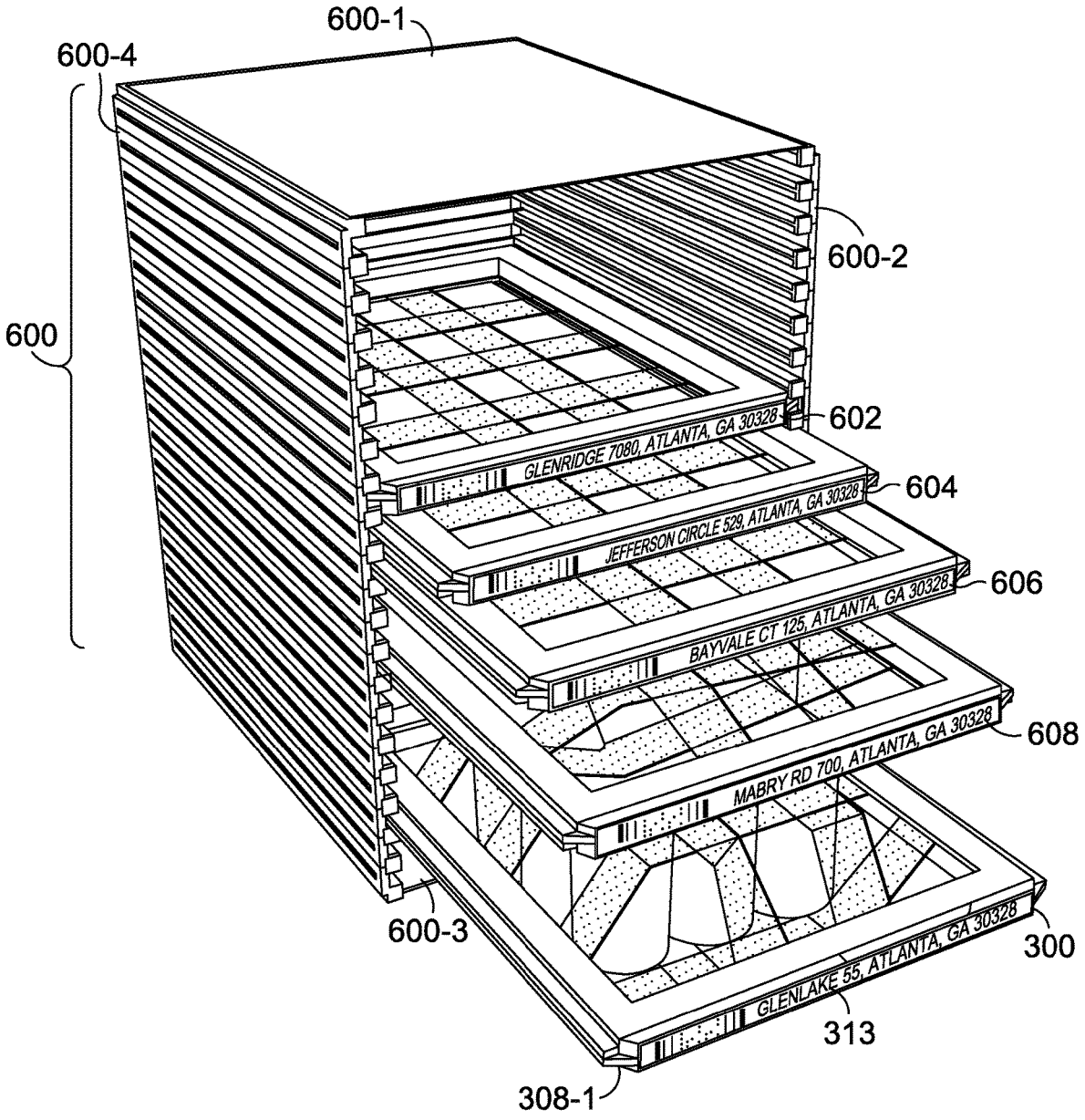
Figure 6B:
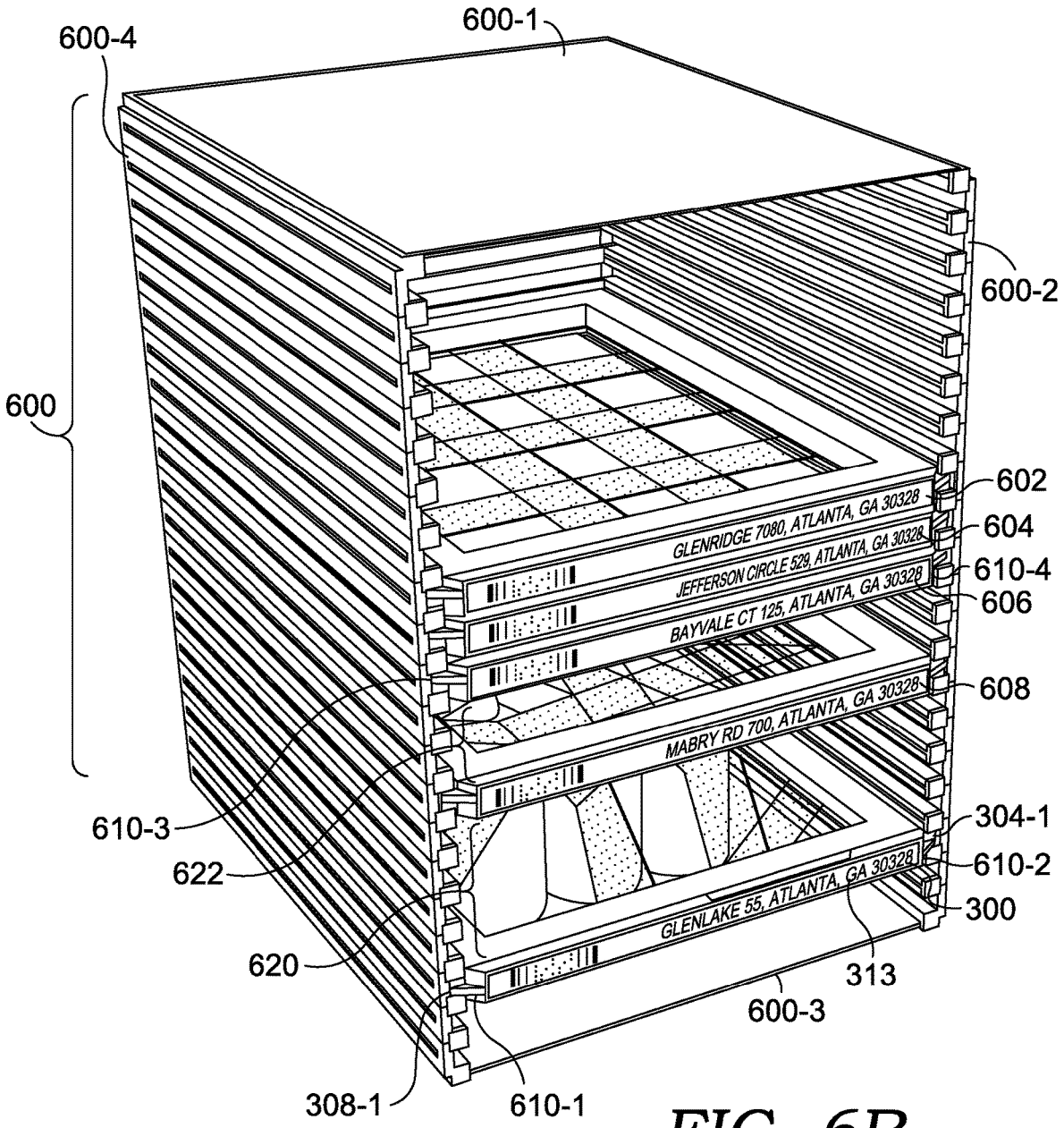
Figure 7:
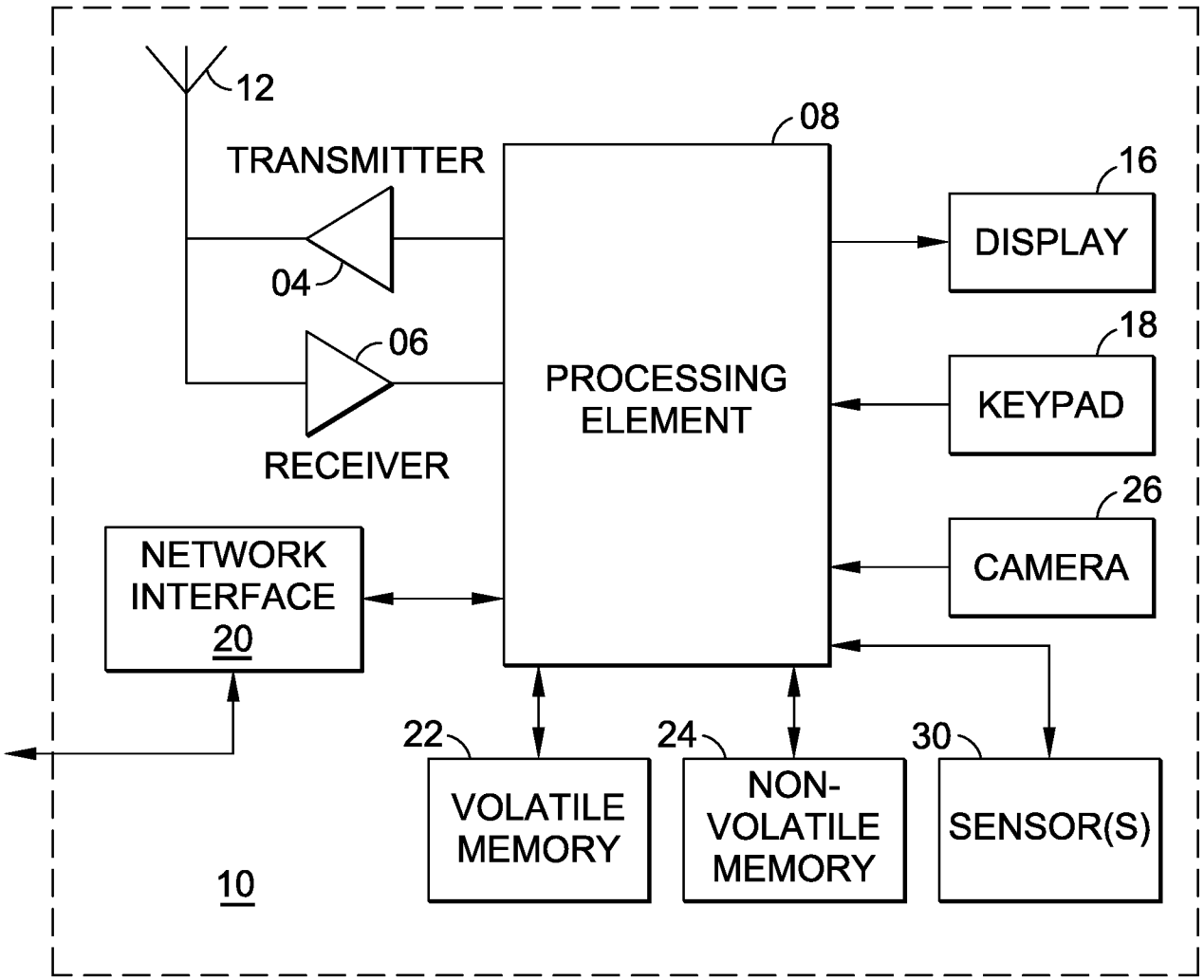

Having thus described the disclosure in general terms, reference will now be made to the accompanying drawings, which are not necessarily drawn to scale, and wherein:

FIG. 1 is a schematic diagram of the inside of a logistics vehicle, according to some embodiments;

FIG. 2 is a schematic diagram illustrating an example sorting facility that includes various holding apparatuses that can be loaded into the logistics vehicle, according to some embodiments;

FIG. 3A illustrates a front perspective view of an item storage unit, according to some embodiments;

FIG. 3B illustrates a front perspective view of the item storage unit of FIG. 3A being partially opened, according to some embodiments;

FIG. 3C illustrates a side perspective view of the item storage unit of FIGS. 3A and 3B being opened, according to some embodiments;

FIG. 3D illustrates a side perspective view opposite of the item storage unit of FIG. 3C being opened, according to some embodiments;

FIG. 3E illustrates a top view of the item storage unit of FIGS. 3C and 3D being opened, according to some embodiments;

FIG. 3F illustrates a perspective front view of the item storage unit of FIG. 3E being closed, according to some embodiments;

FIG. 3G illustrates a front view of a portion of the item storage unit of FIG. 3A, showing the frame component separated from any stretch member, according to some embodiments;

FIG. 4 illustrates a front view of an example item storage unit, according to some embodiments;

FIG. 5A illustrates a scissor holding apparatus in a collapsed state, according to some embodiments;

FIG. 5B illustrates the scissor holding apparatus of FIG. 5A, except that it is in a fully expanded state, according to some embodiments;

FIG. 5C illustrates the expanded scissor holding apparatus of FIG. 5B, which indicates how the scissor holding apparatus stores the item storage unit of FIG. 3A, according to some embodiments;

FIG. 6A illustrates a container holding apparatus loading various items storage units, according to some embodiments;

FIG. 6B illustrates the container holding apparatus of FIG. 6A in a loaded state, such that the corresponding item storage units are completely pushed through the corresponding slots that define the portions of the container holding apparatus, according to some embodiments; and FIG. 7 is a block diagram of a computing entity, for which some embodiments of the present disclosure may be employed in.

DETAILED DESCRIPTION OF THE INVENTION

The present disclosure will now be described more fully hereinafter with reference to the accompanying drawings, in which some, but not all embodiments of the disclosure are shown. Indeed, the disclosure may be embodied in many different forms and should not be construed as limited to the embodiments set forth herein. Rather, these embodiments are provided so that this disclosure will satisfy applicable legal requirements. Like numbers refer to like elements throughout.

I. OVERVIEW

As described above, existing shipping parcels are typically inefficient for storage, both in terms of how items are stored inside of the parcel, and how the parcel itself is stored. For example, some shipping parcel technologies, such as containers or totes require filling material (e.g., packaging air bags or Styrofoam). This not only wastes filling material resources, but items within parcels can still unnecessarily shift or slide, increasing the likelihood of breakage or damage. Further, the filling material can become arduous to deal will (e.g., small pieces of Styrofoam may scatter). These containers, totes, and corrugated packages also tend to be bulky relative to the items they carry, causing unnecessary storage space being consumed when these parcels are stored. For example, many corrugated packages are about twice the size of the items they carry. Not only does this increase the likelihood of shifting, breakage or damage of items as described above, but this causes an unnecessary amount of space being consumed when these parcels are stored in facilities, such as a carrier vehicle, logistics store, or sorting facility. Further, as described above, cardboard parcels are not eco-friendly, as there is lot of cardboard being run through incinerators or landfills.

Various embodiments of the present disclosure are configured to provide one or more solutions to these problems, as well as others, related to these shipping parcel technologies. For instance, some embodiments of the present disclosure are directed to an item storage unit that includes frame components (e.g., a rectangular-shaped enclosure). These frame components may include stretch members (e.g., elastic straps) that have a greater stretching capacity relative to the frame components. In some embodiments, these stretch members are configured to conform tightly or snug against one or more items that are stored within the item storage unit such that there is little to no movement. In this way, there is no need for filling material and the items themselves are less likely to shift or slide, unlike existing parcel technologies. Therefore, there is less likelihood of breakage or damage relative to existing technologies.

In some embodiments, these frame components have lower cross-sections or are lower in diameter (e.g., in a depth z-plane) relative to cardboard parcels, corrugated parcels, containers, totes, or the like. This allows for more efficient use of storage space relative to storing cardboard parcels, containers, or totes. For example, a frame component can be around one or two inches thick and be shaped similar to a picture frame. If two individual frame components (e.g., coupled via a hinge) form an enclosure, and an item is placed between the frame components, for example, the enclosure itself can easily fit in a small grove or slot of a holding apparatus (e.g., a rack), which allows space to more efficiently be utilized in a carrier vehicle, logistics store, or sorting facility.

In some embodiments, these item storage units are configured to be continuously used across multiple shipping operations, unlike cardboard or corrugated parcels, which are disposed of after each delivery. Accordingly, there would be less cardboard materials having to be incinerated or put in landfills, meaning that there is no additional contribution for producing pollutants, toxins, or greenhouse gasses. And less trees would be consumed. For example, these frame components can be made from sturdy polymer-based materials that are configured to continuously load and release items for multiple shipping operations.

In is understood that although this overview section describes various improvements to conventional solutions and technologies, these are by way of example only. As such, other improvements are described below or will become evident through description of various embodiments. This overview is provided to introduce a selection of concepts in a simplified form that are further described below in the detailed description. This overview is not intended to: identify key features or essential features of the claimed subject matter, key improvements, nor is it intended to be used in isolation as an aid in determining the scope of the claimed subject matter.

II. OPERATING ENVIRONMENT

FIG. 1 is a schematic diagram of the inside of a logistics vehicle 120 (also referred to as a "carrier vehicle"), according to some embodiments. A "logistics vehicle" as described herein is any suitable vehicle (e.g., an airplane, freight ship, carrier van, drone, UMV or autonomous car, etc.) that performs or is associated with any suitable logistics or shipping operation. A "shipping operation" as described herein is any suitable operation related to shipping, such as a final mile delivery of an item (or by implication, delivering an item storage unit, as described herein) (e.g., delivering an item to a final destination location, such as a residential address), delivering items from one sorting facility to another, delivering items from a carrier store to a sorting facility, importing or exporting items, flying or otherwise carrying items to/away from a sorting facility, loading an item into a logistics vehicle, picking an item from a logistics vehicle for drop off at another location, etc.

The logistics vehicle 120 includes the holding apparatuses 102 and 106, each of which include individual item storage units (e.g., the item storage unit 104). A "holding apparatus" as described herein refers to any apparatus that is configured to hold or store an item storage unit. For example, a holding apparatus can be a rack, a shelf, cubby, container, or any at least partially formed enclosure (e.g., a box that is enclosed, except for one side). An "item storage unit" as described herein refers to any apparatus that is configured to store or hold one or more items. An "item" represents the payload inside of the item storage unit. For example, items may be the tangible products or goods that consumers buy, such as shoes, staplers, books, devices, tools, documents, gloves, and/or any other product or good. In some embodiments, items additionally or alternatively represent parcels, such as envelopes or small boxes that carry particular goods or products. Examples of various holding apparatuses and items storage units are described in more detail herein.

As illustrated in FIG. 1, holding apparatuses 102 and 106 each store multiple item storage units, such as the item storage unit 104. As described in more detail herein, the combination of the low profile item storage units and the holding apparatuses allows for space savings relative to cardboard boxes or containers inside spaces, such as the interior volume of the logistics vehicle 120. In this way, carrier personnel such as drivers, for example, can more easily maneuver around the interior volume of the logistics vehicle 120 to locate corresponding item storage units for delivery at final delivery destinations or for loading into the holding apparatuses.

FIG. 2 is a schematic diagram illustrating an example sorting facility 200 that includes various holding apparatuses that can be easily loaded into the logistics vehicle 220, according to some embodiments. In some embodiments, the logistics vehicle 120 of FIG. 1 represents the logistics vehicle 220 of FIG. 2. Before an item storage unit is delivered to a consignee or recipient at a destination delivery location, it may go through various operations. For instance, after an item has been dropped off at a carrier store for a delivery request, it may be placed into an item storage unit and routed to the sorting facility 200 where the item storage unit is processed or organized based on information associated with the item. For example, Processing and sorting may include various actions, such as culling where items or item storage units are separated according to shape or other characteristics, capturing information from the item storage unit (e.g., via the reader 220) to retrieve shipping information (e.g., tracking number, destination address, etc.), organizing the item storage units according to a shipment destination, and loading the item storage units (or the holding apparatuses that hold them) into the logistics vehicle 220 so that they can be delivered to recipients or consignees. When the logistics vehicle 220 reaches the delivery destination, carrier personnel may manually pick the item storage unit from the logistics vehicle 220 and deliver the item storage unit to a consignee or recipient.

It is understood that the sorting facility 200 and the logistics vehicle 120 are representative example environments where holding apparatuses or item storage units may be stored. In some embodiments, holding apparatuses or items storage units are used and stored in different contexts, such as in warehouse facilities, retailer stores, business entities, or residential dwellings, for any type of storage (e.g., inventory storage).

The sorting facility 200 includes the conveyor belt machine 225, various parcels and item storage units (e.g., item storage unit 204) that traverse the conveyor belt machine 225, the logistics vehicle 220, the loading operator 210, and the holding apparatuses 202 and 206. The conveyor belt machine 225 may include a belt that is generally formed and/or extends around at least two driving wheels such that by rotation of the driving wheels, the conveyor belt surface may move a parcel, item storage unit, or item in a linear fashion. This may allow the parcel, item storage unit, or item to be picked and placed in a tray or other shelving location in preparation for delivery.

FIG. 2 illustrates that holding apparatuses can be one-shot loaded into the logistics vehicle 220. One-shot loading means that a holding apparatus holding multiple item storage units can be loaded into the logistics vehicle 220. Specifically, for example, the item storage unit 204 may traverse the conveyor belt machine 225 until it arrives near the loading operator 210 and the logistics vehicle 220. The loading operator 210 may then load the item storage unit 204 into the holding apparatus 202 (e.g., the holding apparatus 102). This process may be repeated for multiple items storage units such that multiple item storage units can be loaded into the same holding apparatus 202. Responsively, the loading operator 210 may load the entire holding apparatus 202, which contains multiple items storage units, into the logistics vehicle 200, such that the logistics vehicle 202 looks like the logistics vehicle 120, for example. This improves prior loading processes that require parcels, containers, or totes to be manually loaded into a logistics vehicle one by one, which can waste time and other resources. Moreover, there is space savings inside the sorting facility 200 itself by storing item storage units within the holding apparatuses 202 or 206, as opposed to stacking oversized parcels, for example.

III. EXAMPLE ITEM STORAGE UNITS

FIG. 3A illustrates a front perspective view of an item storage unit 300, according to some embodiments. In some embodiments, the item storage unit 204 of FIG. 2 or item storage unit 104 of FIG. 1 represents the item storage unit 300 of FIG. 3. FIG. 3 illustrates a low profile item storage unit 300 that stores the item shoes 314 and includes various features, as described in more detail below.

The item storage unit 300 is illustrates a frame component 301 that includes sides 302, 304, 306, and 308 (i.e., each of the sides 302, 304, 306, and 308 together makeup the frame component 301). A "frame component" as described herein is any structure that provides a base for or helps secure an item without regard to shape, orientation, or material. Although the frame component 301 in FIG. 3A is illustrated as being rectangular shaped, for example, other shapes may be possible, such as circular or triangular shaped. Further, although the sides 304, 306, and 308 are connected together such that they define an opening or aperture (e.g., the partial aperture 350), it is understood that a frame component 301 can be fabricated as a single plate, panel, or member such that there are no openings or apertures defined by the sides. For example, the shoe items 314 can be situated or held in place via a panel, as opposed to a set of stretch members. In some embodiments, each side 302, 304, 306, or 308 represents an individual frame component.

The storage unit 300 further includes various stretch members 320, 322, 324, 326, and 328 coupled to various surfaces of the frame component 301. A "stretch member" as described herein refers to any component that has a greater stretching capacity or is more flexible relative to a frame component. Alternatively or additionally, a stretch member is any material that has a stretching capacity or flexibility over some threshold value (e.g., 50%, 60%, or 70%). In some embodiments, "stretch capacity" refers to the length of the stretch member when stretched to its maximum divided by the length of the same stretch member when no stretching is performed (e.g., minus 1). Stretch capacity can be quantified in terms of percentage, or raw displacement or magnitude values. For example, stretch percentage can be 16/10−1=0.6, which means that a particular stretch member or frame component has a stretch percentage of 60% (e.g., a stretch member of frame component can be stretched up to 60% of its original non-stretched size). In some embodiments, a stretch member covers an entire frame component, rather than crisscrossed strips as illustrated in FIG. 3A.

In some embodiments, "flexibility" is defined as the amount of force or pressure required to deform or displace some object past a particular value (e.g., the breaking point) (e.g., bending force). A first object is more flexible relative to a second object if the first object requires less force to deform or displace relative to a second object. For example, flexibility can be in terms of Newtons or pressure required to displace or deform a stretch member versus a frame component. In some embodiments, "flexibility" alternatively or additionally includes "stretch capacity," as described herein. Alternatively or additionally, flexibility can refer to what is known as the "elastic modulus" E, which is defined as the stress applied to a material divided by the strain.

A stretch member may include any suitable material, such as rubber, pliable polymers, textiles, or materials formed using elastomeric yarns. Elastomeric yarns may generally provide a maximum stretch greater than about 200% under load (stretched state) prior to returning to its non-stretched state when the load is removed, and some elastomeric yarns provide a maximum stretch of about 400%. Examples of elastomeric yarn types include SPANDEX®, lycra, rubber, and the like. Moreover, examples of stretch members may include stretch woven materials, stretch knit materials, stretch non-woven materials, and the like. The term "non-stretch member" as used herein refers materials that do not have as great of stretching capacity or flexibility relative to stretch members, such as a frame component. In some embodiments, a non-stretch member is formed using non-elastomeric yarns that generally do not stretch over a threshold amount (e.g., cotton, silk, polyester, conventional denim, and/or other non-elastic polymers).

In some embodiments, as illustrated in FIG. 3A, the stretch members are made from a transparent polymer-based material. Examples of such material can be flexible vinyl sheets (also known as PVC). Other examples include Specialty Acrylic Sheet, Polycarbonate Sheet, High-Density Polyethylene, Kydex Thermoplastic Sheet, and Acryolonitrile Butadiene Stryren. In some embodiments, any frame component described herein is made from a hard plastic polymer material. Examples include Polypropylene or High Density Polyethylene (HDPE). In some embodiments, frame components include reclaimed polymer materials, such as recyclable polyethylene terephthalate. Such reclaimed polymer materials in some embodiments are harvested from sea waste (e.g., plastic six pack rings, water bottles, etc.).

As illustrated in FIG. 3A, there are multiple stretch members coupled to various surfaces of the frame component 301. Specifically, for example, the end 320-1 (e.g., a first end) of the stretch member 320 is coupled to the surface 302-1 (e.g., a first surface) of the side 302 of the frame member 301 and the end 320-2 (e.g., a second end) of the same stretch member 320 is coupled to the surface 306-1 (e.g., a second surface) of the side 306 of the frame component 301. These components as well as any component may be coupled in any suitable manner, such as being attached via screws, nuts, nails, hook- and loop fasteners, snapping mechanisms, and the like.

All of the other stretch members are similarly coupled to the frame component 301. For example, the end 328-1 of the stretch member 328 is coupled to the surface 304-2 of the side 304. Likewise, the end 328-2 of the same stretch member 328 is coupled to the surface 308-2 of the side 308. In this way, as illustrated in FIG. 3A, the stretch members 328 and 320 are substantially perpendicular to each other, as well as the other stretch members. Each stretch member is perpendicular to at least one other stretch member.

As illustrated in FIG. 3A, the stretch members have corresponding stretch members that they are substantially aligned with, but which are located on the other side of the items 314. For example, the stretch member 328 conforms to (e.g., abuts) a first front surface (not shown) of the items 314 and the stretch member 330, which is directly aligned with the stretch member 328, conforms to a back surface (not shown) of the items 314. In this way, the items 314 are configured to be situated between stretch members, such as the stretch member 328 and 330, for example. In some embodiments, these other stretch members, such as the stretch member 330, are coupled to their own separate frame component (not shown), which is illustrated and described in more detail below. As illustrated in FIG. 3A, each of the stretch members 320, 322, 324, 326, and 328 at least partially conform (e.g., due to their stretch capacity or flexibility) to a surface of the items 314. In this way, the items 314 are less likely to shift or slide. Therefore, there is less likely chance of breakage or damage of the items 314 and there is no need for filler materials, unlike existing parcel technologies.

As illustrated in FIG. 3A, the side 304 includes a lip 304-1 (e.g., a first lip), which runs parallel along the length of the side 304. Likewise, the side 308 includes the lip 308-1 (e.g., a second lip), which also runs parallel along the length of the side 308. A "lip" as described herein refers to a jutting edge or protrusion piece that is smaller in diameter or cross section relative to the frame component side it is a part of. The lips 304-1 and 308-1 are configured to be placed into respective slots or groves of a holding apparatus such that the entire item storage unit 300 can be secured to a holding apparatus, as described in more detail below.

The side 304 of the frame component 301 includes a tag 310 (e.g., active or passive RFID tag), which is embedded into or otherwise coupled to the surface 380 of the side 304. In some embodiments, the tag 310 stores shipping information and is configured to provide the shipping information to a reader device (e.g., a Delivery Information Acquisition Device (DIAD) carried by delivery personnel driving the logistics vehicle 120). In some embodiments, such shipping information can include destination shipping address (where the item storage unit 300 will be shipped to), name of consignee (or consignor/shipping entity) who is to receive the items 314, the day the items 314 are to be delivered to a consignee, item storage unit 300 attributes (e.g., weight, length, width of the item storage unit 300), special shipping instructions (e.g., place the item storage unit 300 on a residential porch since consignee will be gone), and/or alternative destination locations (e.g., access point information, such as retailer locations).

Alternatively or additionally, shipping information can include an identifier that identifies the item storage unit 300. This can be used different ways, such as being able to detect that a particular item storage unit has been delivered. For example in response to a reader device reading the tag 310, the reader device can send a notification to a logistics server indicating that the item storage unit 300 has been delivered to its destination location based on receiving its identifier from the reader device. Accordingly, for instance, when carrier personnel drops off the item storage unit 300 of at a residential doorstep, for example, the carrier personnel can uses its DIAD or other reader device to scan the tag 310 in order to indicate that the item storage unit 300 has been delivered.

In some embodiments, the tag 310 may be any suitable tag, machine, manufacture, module, and/or computer-readable indicia. "Computer-readable indicia" as described herein is any tag (e.g., RFID or NFC tag) information, bar code, data matrix, numbers, lines, shapes, and/or other suitable identifier that is machine-readable (and tend not to be readable by a human) because machines can process the data. For example, the tag 310 can be Radio Frequency Identification (RFID) tags (active or passive), Near-field Communication (NFC) tags, optical computer-readable indicia, bar code computer-readable indicia, magnetic ink character recognition computer-readable indicia, and/or the like.

As illustrated in FIG. 3A, there is an electronic ink display 312 coupled to a surface of the side face 313. An "electronic ink display" (also referred to as "E-ink") refers to electronic ink placed on a medium. In some embodiments, the electronic ink display 312 refers to a low-power, paper-like display for e-readers (e.g., AMAZON KINDLE or other device). In some embodiments, the electronic ink display 312 includes microcapsules that are suspended in a liquid that is incased within a film layer. The microcapsules include positively charged white particles and negatively changed black particles (the electronic ink). A negative electrical field is applied to the electronic ink display 312, thereby causing the white particles to rise to the surface and a positive electrical field causes the black particles to rise to the surface of the electronic ink display 312. By applying (via a device, such as an e-reader) different fields at different parts of the electronic ink display 312, e-ink produces a monochromatic text display. The result is a display that resembles printed paper and ink, and consumes less power relative to backlit liquid crystal display (LCD), for example.

In some embodiments, the electronic ink display 312 includes some or all of the shipping information described above with respect to the tag 310. For example the electronic ink display 312 may include in that contains human-readable shipping information (e.g., consignee address, consignee name, weight of item storage unit 300, etc.) and a barcode (e.g., that contains a tracking number, identifiers of manufacturer of the items 314, or other identifier information). In some embodiments it may be more desirable for users to read shipping information on the electronic ink display 312, as opposed to obtaining shipping information from the tag 310 because the user does not have to actively scan (e.g., using an RFID reader) the electronic ink display 312 to obtain relevant information, which the tag 310, however, requires in some embodiments.

By incorporating the electronic ink display 312, there is no need for paper or adhesive shipping labels or the like, which is common on existing corrugated parcels, for example. Rather, the electronic ink display 312 and/or tag 310 can include this information. In this way, the item storage unit 300 and the items 314 are what is shipped to a delivery destination as part of a final-mile logistics operation using the electronic ink display 312 and/or the tag 310, as opposed to a paper shipping label.

In some embodiments, the item storage unit 300 additionally or alternatively includes other sensors or components. For example, in some embodiments, the item storage unit 300 includes a temperature sensor to measure the ambient outside temperature, which allows, for example, carrier personnel to gauge whether to put certain temperature-delicate items within the item storage unit 300, such as candles or crayons, for example. Alternatively or additionally, the storage unit 300 includes a gyroscope and/or accelerometer to gauge the movement, acceleration, velocity, or positioning of the item storage unit 300. For example, when the angular positioning of the item storage unit 300 is outside of a threshold gyroscope reading, a processor (not shown) located within the item storage unit 300 may responsively send a control signal to a speaker (not shown) coupled to the item storage unit 300, causing an audible beeping noise, for example. This may be useful for users, such as consignees, who are unfamiliar with the item storage unit 300 and may be holding it the wrong way, such that items will fall out easy when they are not correctly held. This may be likely in embodiments where there is no explicitly incorporated fastening mechanism between frame components, so it may be easy for items to fall out.

In another example, when there is an acceleration above an accelerometer threshold, this may indicate that the item storage unit 300 was dropped or otherwise taken. In response to this reading over a threshold, some embodiments responsively send a notification to a consignee device (e.g., notifying them that someone has picked up their items). Alternatively, a notification may be sent to a logistics entity to inform them that the item storage unit 300 has been dropped, thereby mitigating any potential return request refunds due to the faultiness of the item, or the like. Alternatively or additionally, cameras may be included on the item storage unit 300, which include object detection capabilities (e.g., via a Convolutional Neural Network (CNN)), such that trained objects can be detected with bounding boxes and sent over a network, such as to a consignee device. For example, object detection algorithms can be trained to detect humans and detect any time a human gets close to or touches the item storage unit 300. Responsive to this detection, notifications can be sent to a consignee device and/or logistics entity.

FIG. 3B illustrates a perspective front view of the item storage unit 300 of FIG. 3A being partially opened, according to some embodiments. As illustrated in FIG. 3B, the items storage unit 300 is identical to FIG. 3A, except that a different parcel item 315 has been placed inside of the item storage unit 300 in FIG. 3B and there are other portions of the item storage unit 300 being illustrated.

FIG. 3B illustrates that an item (item 315) can be placed between different frame components and stretch members such that the item storage unit 300 acts as an enclosure or encompasses the item to offer 360 degrees of protection on all sides of one or more items. Specifically, the frame component 301 of FIG. 3A is coupled to the frame component 390 near the side face 313, as described in more detail below. The frame component 390 includes its own set of stretch members, such as stretch member 338. In some embodiments, the frame component 390 is identical to the frame component 301 in terms of its side orientation and coupling to stretch members, as described with respect to FIG. 3A.

FIG. 3C illustrates a perspective side view of the item storage unit 300 of FIGS. 3A and 3B being opened, according to some embodiments. FIG. 3C illustrates how the frame components 301 and 390 are coupled to each other. Specifically, the joint component 360 is coupled to a surface 372 of the frame component, and the joint component 360 is further coupled to the surface 374 of the frame component 390. The joint component 360 thus couples the frame components 301 and 390 together. Some embodiments that describe frame components being "coupled" to each other need not directly be coupled to each other but may be coupled to each other via a joint component. The joint component 360 allows the frame components 301 and 390 to axially rotate relative to each other about a fixed axis 360-1 (e.g., a pin) of the joint component 360, which runs parallel to the frame components 301 and 390. This fixed axis 360-1 allows the frame components 301 and 390 to axially rotate perpendicular to the length of the fixed axis 360-1 in a limited arc or around 360 degrees such that the item storage unit 300 forms an enclosure when surfaces 301-1 and 390-1 are coupled to each other and when surfaces 301-2 and 390-2 are coupled to each other. In this way, the joint component 360 allows for an angle of rotation between the frame component 301 and 390, whether the item storage unit 300 is forming an enclosure (is closing) or is being extended (is opening), as illustrated, for example in the positioning of the frame components 301 and 390 in FIG. 3C.

In some embodiments, the surfaces 301-1 and 390-1 and/or the surfaces 301-2 and 390-2 have no direct fastening mechanisms that coupled the frame components 301 and 390 to each other. Rather, as described in more detail below, these surfaces are fixed to each other when placed in a slot or other holding mechanism, as described in more detail below with respect to a holding apparatus. Alternatively, in some embodiments the surfaces 301-1 and 390-1 and/or the surfaces 301-2 and 390-2 include direct fastening mechanisms, such as clasping or snap-in components (e.g., magnetic clasps, button male and female members), hook and loop fasteners, adhesive, or the like. This allows the frame components 301 and 390 to directly be fastened to each other when an item is enclosed such that there is less likely of a chance that the item will fall out, for example.

In some embodiments, the joint component 360 represents a mechanical bearing device, such as a hinge device. Examples of hinge devices include a barrel hinge, a Mortise hinge, a continuous hinge, a European hinge, and a pivot hinge. Other joint components can be a flap fitting or mechanical ball-and-socket joint, which allows for more degrees of freedom between the frame components 301 and 390, relative to a hinge device.

FIG. 3D illustrates a perspective side view opposite of the item storage unit 300 of FIG. 3C being opened, according to some embodiments. The item storage unit 300 of FIG. 3D illustrates the side face 313, which more clearly illustrates the ink display 312. In some embodiments, the joint component 360 of FIG. 3C is directly behind, in a z-plane, the side face 313. FIG. 3D also illustrates the frame components 301 and 309. FIG. 3E illustrates a top view of the item storage unit 300 of FIGS. 3C and 3D being opened, according to some embodiments. The frame components 301 and 390 are coupled to each other (via the hinge component 360). The side 304 of the frame component 390 and side 304 of the frame component 301 are illustrated in FIG. 3E. FIG. 3E also illustrates that surfaces 305-1 of the side 305 and 304-1 of the side 304 are closer to each other relative to surfaces 305-2 of the side 305 and 304-2 of the side 304 in an opened state.

FIG. 3F illustrates a perspective front view of the item storage unit 300 being closed, according to some embodiments. Specifically, surfaces along the side 302 of the frame component 301 are abutting, touching, or coupled to surfaces of the frame component 390. For instance, surface 390-1 of the frame component 390 is abutting the surface 302-1 of the frame component 301. This represents the item storage unit 300 being in a "closed" position, relative to the "open" position as described, for example, with respect to FIGS. 3C, 3D, and 3E. In some embodiments, when the surfaces 301-1, 301-2, 390-1, and 390-2 are abutting, touching, or coupled to each other (see FIG. 3C), this also represents a "closed" position.

FIG. 3F further illustrates how a cross section or diameter of the item storage unit 300 is narrower relative to existing parcels. In some embodiments, the diameter or cross section of the item storage unit 300 (e.g., the vertical length between points 302-3 and 390-3) is between 1 to 4 inches. This smaller cross section and/or the square/rectangular shaped allows for easy handling and storage by loading operators. In particular, these attributes may make it easier to clasp by automated components (e.g., a robotic arm, an Unmanned Aerial Vehicle (UAV)), and the like.

FIG. 3G illustrates a front view of a portion of the item storage unit 300 of FIG. 3A, showing the frame component 301 separated from any stretch member, according to some embodiments. FIG. 3G illustrates that in some embodiments, without any stretch members, the frame component 301 is defined by a fairly large aperture 307, and each of the sides 304, 306, 308, and 302. Accordingly, each of these sides come together to define the aperture 307. However, as illustrated in FIG. 3A, the aperture 307 is reduced or covered via multiple stretch members when they are coupled to the frame component 301. Although FIG. 3G illustrates the frame component 301, it is understood that frame component 390 can be identically illustrated as shown in FIG. 3G. FIG. 3G also illustrates what a stretch member by itself may look like when isolated from the frame component 301, as illustrated by the stretch member 320. Accordingly, the stretch member may be elongated and have ends.

FIG. 4 illustrates a front view of an example item storage unit 400, according to some embodiments. FIG. 4 illustrates a frame component 401, coupled to the stretch members 420, where the item 413 is situated between the frame component 401 and the stretch members 420. In this way, a portion 420-1 of the stretch members 420 conforms to a front surface 413-1 of the item 413, and a second rear surface (not shown) of the item 413 abuts a surface 401-1 of the frame component 401. This prevents shifting or sliding, which has advantages, as described herein. This illustrates that in some embodiments, unlike the frame component 301 of FIG. 3A, some frame components (e.g., the frame component 401) have no apertures, such as the aperture 307 of FIG. 3G.

Alternatively, in some embodiments, however, the frame component 401 does have an aperture or at least is only defined limited portions of the item storage unit 400. For example, in some embodiments, the frame component 401 may end at the portions 420-2, 420-4, and 420-4 of the stretch members 420. Accordingly, the second rear surface (not shown) of the item 413 in some embodiments abuts other stretch members (not shown) or components, as opposed to the frame component 401.

In some embodiments, the stretch members 420 and the bottom portion of the frame component 401 (e.g., that includes surface 401-1) acts as a type of "pocket" for the item 413. For example, the portion 420-2 of the stretch members 420 may be coupled to the surface 401-2 of the frame component 401. Likewise, the portion 420-3 of the stretch members 420 may be coupled to the surface 401-3 of the frame component 401. Further, the portions 420-5 illustrated by the circular arc are coupled to the corresponding surfaces of the frame component 401. However, the middle portion 420-4 of the stretch components 420 may not be coupled to any portion of the frame component 401, such that the stretch component portion 420-4 forms an opening, aperture, or pocket such that the item 413 can fit tightly or snug when the item 413 is placed into the pocket.

FIG. 4 also illustrates that the stretch members 420 can be any type of stretch member (e.g., nylon mesh), as opposed to vinyl or other polymer-based stretch members, as illustrated in FIG. 3A, for example. FIG. 4 also illustrates that the frame component 401 (or any item storage unit in general) need not be in the form of a particular rectangular, square, or other shape as illustrated in FIG. 3A. Rather, it can be circular or other shape.

IV. EXAMPLE HOLDER APPARATUSES

FIG. 5A through FIG. 5B illustrates a side perspective view of a scissor holding apparatus 500 that goes from a collapsed state (FIG. 5A) to a fully expanded state (FIG. 5B), according to some embodiments. FIG. 5A illustrates the scissor holding apparatus 500 in a collapsed state. The scissor holding apparatus 500 in FIG. 5A includes a top plate 502, a side plate 510, a side plate 512, an opening 511, and sliding actuators 506, 508. FIG. 5A illustrates that side plate 510 being at least partially defined by the slot 510-1 and the side plate 512 is at least partially defined by the slot 512-1.

FIG. 5B illustrates the scissor holding apparatus 500 of FIG. 5A, except that it is in a fully expanded state. FIG. 5B illustrates the scissor holding apparatus 500 expanding to an expanded state based on a scissor lift mechanism via the sliding actuators 506 and 508, as well as the scissor assemblies 520, 522, 524, and 526. Specifically, in response to the slide actuators 506, 508 of FIG. 5A sliding (based on user-induced force) away from each other (indicated by the arrows) along a length of the plane of the side plate 510, the top plate 502 and the side plates 510, 512 elevate from a first lower position illustrated in FIG. 5A, to a relatively higher position, as illustrated in FIG. 5B. Likewise, the slide actuators 506 and 508 are farther apart from each other in FIG. 5B relative to FIG. 5A. This is because of the sliding motion that the slide actuators experience from FIG. 5A to FIG. 5B. Further, the base plate 530 is also now exposed in response to the elevating of the side plates 510 and 512.

FIG. 5B further illustrates that the scissor lift assemblies 520, 522, 524, and 526 are now exposed and extended, relative to FIG. 5A (which are not illustrated in FIG. 5A because they are in a compressed or collapsed state). In some embodiments, the slide actuators 506 and 508 include an extension, prong, or tine that is configured to engage or apply force to the scissor legs 520-1, 522-1, 524-1, and 526-1 so that the corresponding scissor lift assemblies extend, thereby causing the top plate 502 and side plates 510, 512 to elevate. Specifically, for example, an extension coupled to the sliding actuator 508 simultaneously engages or pushes the scissor legs 524-1 and 526-1 in response to the sliding actuator 508 sliding laterally away from the sliding actuator 506. In response to this engagement, the scissor lift assemblies 524 and 526 extend or elongate due to the engagement, thereby causing the top plate 502 and the side plates 510 and 512 to become elevated.

The scissor lift assemblies 520, 522, 524, and 526 rely on an elongation mechanism to provide vertical lifting (i.e., elevating of the top plate 502 and the side plates 510, 512) depending on a rotational or linear input. These machines are capable of lifting significant loads safely and efficiently and in this instance, they lift ant hold in place surfaces 502 and 530 that keep the content safe from impacts and puncture forces that may otherwise damage contents. In some embodiments, the scissor lift assemblies 520, 522, 524, and 526 are hinged with pivot points to make the assembly looks like several sets of connected scissor blades (e.g., scissor leg 520-1). In some embodiments, as scissor legs move up and down, they perform an open-close motion similar to scissors because of this mechanism that uses the linked, folding supports (e.g., scissor lift legs 520-1, 522-1, 524-1, and 526-1) in the crisscross X pattern which known as a pantograph or scissor mechanism. This is a mechanical device that includes a series of connected parallelograms with hinged intersections that permit a user or operator to elongate the mechanism.

In various embodiments, the scissor lift assemblies 520, 522, 524, and 526 include a series of connected parallelograms with hinged intersections that permit the operator to elongate the mechanism and maintain the integrity of the geometric figure. As L, the length of the base decreases (e.g., an extension from the sliding actuator 508 engages the scissor leg 524-1), the pantograph expands. In other words, when two points on different scissor legs of the same scissor lift assembly increases, the X-axis between the scissor legs decreases, the Y-axis increases leading to an elevation of the top plate 502, as well as the side plates 510, 512. When the scissor legs are pushed together, the scissor holding apparatus 500 extends, raising the top plate 502, and the side plates 510, 512 vertically. In an illustrative example, when the scissor legs 524-1 and 524-2 are brought closer to each other (via the sliding of the sliding actuators 506, 508), the scissor lift assembly 524 expands, such that the top late 502 and side plates 510, 512, are elevated. Conversely, when the scissor legs are pushed closer together, the scissor holding apparatus 500 contracts or collapses, thereby lowing the top plate 502, and the side plates 510, 512.

FIG. 5C illustrates the expanded scissor holding apparatus 500 of FIG. 5B, which indicates how the scissor holding apparatus 500 stores the item storage unit 300. As described above with respect to FIG. 3A, the item storage unit 300 includes the lip 304-1 and the lip 308-1. These lips are configured to be placed in corresponding slots within the scissor holding apparatus 500. Specifically, the lip 308-1 is configured to be placed into the slot 510-1 of the side plate 510 and the lip 304-1 is configured to be placed into the slot 512-1 of the side plate 512 such that the item storage unit 500 fits snug or is tightly secured to the scissor holding apparatus 500. As illustrated herein with respect to FIG. 3A, in some embodiments, frame components have not direct fastening mechanism. In some embodiments, there is no securing of frame components if and until the item storage unit 300 is in a closed position, and is placed in a corresponding slot in the holding apparatus (e.g., the scissor holding apparatus 500). This ensures that there is little to know movement allowed opening movement of the item storage device 300 because of the slot shape (e.g., 510-1) conforming directly to the shape of the lips (e.g., the lip 308-1).

FIG. 5C additionally illustrates that the top plate 502 (and/or the base plate 530) can be adjusted, via the sliding actuators 506, 508 (as described above), based at least in part on the size of the item inside of the item storage unit 300. For example, the items 314 may be a particular vertical length value (e.g., 3 inches from the outer surface of a frame component). Accordingly, a user may first engage the sliding actuators 506, 508, to make the scissor holding apparatus 500 go from a collapsed state to an expanded state, as illustrated in FIGS. 5A and 5B. Responsively, the user may insert the item storage unit 300 into the slots 308-1 and 512-1, as illustrated in FIG. 5C. Responsively, the user may further adjust the height of the top plate 502 so that the top of the items 314 (or more specifically the stretch members encompassing the items 314) abut against or are closer to the bottom (not shown) of the top plate 502. For example, in response to the storing of the item storage unit 300 into the scissor holding apparatus 500 as illustrated in FIG. 5C, the user may slide the slide actuators 506 and 508 closer to each other, thereby collapsing the top plate 502 such that there is less open space between the top plate 502 (and/or the base plate 530) and the item storage unit 300. This allows for space savings and also ensures that contents are safely suspended inside the protection of the outer surfaces, protected from shock or puncture damages, as described herein. For example, additional item storage units can be placed on the top plate 502 and/or on the base plate 530, which will now be physically closer to the item storage unit 300. In other words, there is less open space between items (and items are more securely fixed), unlike existing technologies, for example, which have more space between the items and the parcels that hold the items and require package filling.

FIG. 6A illustrates a container holding apparatus 600 loading various items storage units 602, 604, 606, 608, and 300, according to some embodiments. The container holding apparatus 600 includes a top member 600-1 a side member 600-2, a bottom member 600-3, and a side member 600-4, each of which together form an interior volume of space and a plurality of slots (e.g., the slots 610-1 and 610-2). As described above with respect to the scissor holding apparatus 500 of FIG. 5B, the container holding apparatus 600 similarly secures items storage units via slots. For example, the lip 308-1 is configured to be placed into the slot 610-1, whereas the lip 304-1 is configured to be placed into the slot 610-2. In this way, the item storage unit 300 can be placed into and fit within the container holding apparatus 600, as illustrated in FIG. 6B.

FIG. 6B illustrates the container holding apparatus 600 of FIG. 6A in a loaded state, such that the corresponding item storage units are completely pushed through the corresponding slots that define the portions of the container holding apparatus 600. Accordingly, for example, FIG. 6A represents a first time indicating a loading of the item storage units and FIG. 6B represents a second time subsequent to the first time where the items storage units have been loaded (i.e., they are completely secured to the container holding apparatus 600).

FIG. 6B further illustrates that various item storage units can be placed in any suitable slots depending on the size of the items within the corresponding item storage units. For example, at a first time a user may load the item storage unit 300 into the container holding apparatus 600 via the slots 610-1 and 610-2. Based on the height of the items 314, the user may place the item storage unit 608 into the slots 610-4. This explains, for example, why there is more open space 620 (and more slots) between the item storage unit 300 and the item unit 608 relative to the open space 622 between the item storage unit 608 and the item storage unit 606. FIG. 6B further illustrates that the item storage units 602 and 604 have envelope or thin parcels as items. Accordingly, there is very little or no open space between the parcels 602 and 604.

FIG. 6B also illustrates the potential for space savings between items, unlike existing parcel or container technologies. This is due in part at least because of the narrow diameter or cross section of the side edges (e.g., side edge 313) of the item storage units, as well as the ability to place item storage units within any area within the interior volume of the container holding apparatus 600 based on the multiple slots (e.g., the slot 610-1).

V. EXAMPLE COMPUTING DEVICE

In some embodiments, any item storage unit, reader device, and/or holding apparatus described herein includes a computing device. The computing device may include a non-transitory computer-readable storage medium storing applications, programs, program modules, scripts, source code, program code, object code, byte code, compiled code, interpreted code, machine code, executable instructions, and/or the like (also referred to herein as executable instructions, instructions for execution, program code, and/or similar terms used herein interchangeably). Such non-transitory computer-readable storage media include all computer-readable media (including volatile and non-volatile media). These components may be used to carry out the functionality as described above with regard to the sensors FIG. 3A, such as the tag 310, an object detection camera, an accelerometer, and/or a gyroscope.

In one embodiment, a non-volatile computer-readable storage medium may include a floppy disk, flexible disk, hard disk, solid-state storage (SSS) (e.g., a solid state drive (SSD), solid state card (SSC), solid state module (SSM)), enterprise flash drive, magnetic tape, or any other non-transitory magnetic medium, and/or the like. A non-volatile computer-readable storage medium may also include a punch card, paper tape, optical mark sheet (or any other physical medium with patterns of holes or other optically recognizable indicia), compact disc read only memory (CD-ROM), compact disc-rewritable (CD-RW), digital versatile disc (DVD), Blu-ray disc (BD), any other non-transitory optical medium, and/or the like. Such a non-volatile computer-readable storage medium may also include read-only memory (ROM), programmable read-only memory (PROM), erasable programmable read-only memory (EPROM), electrically erasable programmable read-only memory (EEPROM), flash memory (e.g., Serial, NAND, NOR, and/or the like), multimedia memory cards (MMC), secure digital (SD) memory cards, SmartMedia cards, CompactFlash (CF) cards, Memory Sticks, and/or the like. Further, a non-volatile computer-readable storage medium may also include conductive-bridging random access memory (CBRAM), phase-change random access memory (PRAM), ferroelectric random-access memory (FeRAM), non-volatile random-access memory (NVRAM), magnetoresistive random-access memory (MRAM), resistive random-access memory (RRAM), Silicon-Oxide-Nitride-Oxide-Silicon memory (SONOS), floating junction gate random access memory (FJG RAM), Millipede memory, racetrack memory, and/or the like.

In one embodiment, a volatile computer-readable storage medium may include random access memory (RAM), dynamic random access memory (DRAM), static random access memory (SRAM), fast page mode dynamic random access memory (FPM DRAM), extended data-out dynamic random access memory (EDO DRAM), synchronous dynamic random access memory (SDRAM), double information/data rate synchronous dynamic random access memory (DDR SDRAM), double information/data rate type two synchronous dynamic random access memory (DDR2 SDRAM), double information/data rate type three synchronous dynamic random access memory (DDR3 SDRAM), Rambus dynamic random access memory (RDRAM), Twin Transistor RAM (TTRAM), Thyristor RAM (T-RAM), Zero-capacitor (Z-RAM), Rambus in-line memory module (RIMM), dual in-line memory module (DIMM), single in-line memory module (SIMM), video random access memory (VRAM), cache memory (including various levels), flash memory, register memory, and/or the like. It will be appreciated that where embodiments are described to use a computer-readable storage medium, other types of computer-readable storage media may be substituted for or used in addition to the computer-readable storage media described above.

As should be appreciated, various embodiments of the present disclosure may also be implemented as methods, apparatus, systems, computing devices/entities, computing entities, and/or the like. As such, embodiments of the present disclosure may take the form of an apparatus, system, computing device, computing entity, and/or the like executing instructions stored on a computer-readable storage medium to perform certain steps or operations. However, embodiments of the present disclosure may also take the form of an entirely hardware embodiment performing certain steps.

Turning now to FIG. 7, computing entity 10 may be configured for functionality described herein with respect to one or more sensors. In some embodiments, a computing entity 10 is embedded within or otherwise coupled to an item storage unit, a reader device and/or a holding apparatus as described herein. In general, the terms device, system, computing entity, entity, computing device, and/or similar words used herein interchangeably may refer to, for example, one or more: computers, computing entities, desktops, mobile phones, micro-computers (e.g., RASBERY PI), tablets, phablets, notebooks, laptops, distributed systems, vehicle multimedia systems, autonomous vehicle onboard control systems, watches, glasses, key fobs, radio frequency identification (RFID) tags/readers, ear pieces, scanners, imaging devices/cameras (e.g., part of a multi-view image capture system), wristbands, kiosks, input terminals, servers or server networks, blades, gateways, switches, processing devices, processing entities, set-top boxes, relays, routers, network access points, base stations, the like, and/or any combination of devices or entities adapted to perform the functions, operations, and/or processes described herein. Computing entity 10 can be operated by various parties, including carrier personnel (sorters, loaders, delivery drivers, network administrators, and/or the like).

As shown in FIG. 7, the computing entity 10 can include an antenna 12, a transmitter 04 (e.g., radio), a receiver 06 (e.g., radio), and a processing element 08 (e.g., CPLDs, microprocessors, multi-core processors, coprocessing entities, ASIPs, microcontrollers, and/or controllers) that provides signals to and receives signals from the transmitter 04 and receiver 06, respectively. In some embodiments, the computing entity 10 includes one or more sensors 30 (e.g., a camera with object detection capabilities). In some embodiments, at least one of the computing entities 10 is coupled to the item storage unit 300. The one or more sensors 30 can be one or more of: a pressure sensor, an accelerometer, a gyroscope, a geolocation sensor (e.g., GPS sensor), a radar, a lidar, sonar, ultrasound, an object recognition camera, and any other suitable sensor used to detect objects or obtain information in a geographical environment that an item storage unit and/or holding apparatus is in.

The signals provided to and received from the transmitter 04 and the receiver 06, respectively, may include signaling information in accordance with air interface standards of applicable wireless systems. In this regard, the computing entity 10 may be capable of operating with one or more air interface standards, communication protocols, modulation types, and access types. More particularly, the computing entity 10 may operate in accordance with any of a number of wireless communication standards and protocols. In a particular embodiment, the computing entity 10 may operate in accordance with multiple wireless communication standards and protocols, such as UMTS, CDMA2000, 1×RTT, WCDMA, TD-SCDMA, LTE, E-UTRAN, EVDO, HSPA, HSDPA, Wi-Fi, Wi-Fi Direct, WiMAX, UWB, IR, NFC, Bluetooth, USB, and/or the like. Similarly, the computing entity 10 may operate in accordance with multiple wired communication standards and protocols, such as those described above with regard to a logistics server via a network interface 20.

Via these communication standards and protocols, the computing entity 10 can communicate with various other entities using concepts such as Unstructured Supplementary Service information/data (USSD), Short Message Service (SMS), Multimedia Messaging Service (MMS), Dual-Tone Multi-Frequency Signaling (DTMF), and/or Subscriber Identity Module Dialer (SIM dialer). The computing entity 10 can also download changes, add-ons, and updates, for instance, to its firmware, software (e.g., including executable instructions, applications, program modules), and operating system.

According to particular embodiments, the computing entity 10 may include location determining aspects, devices, modules, functionalities, and/or similar words used herein interchangeably. For example, the computing entity 10 may include outdoor positioning aspects, such as a location module adapted to acquire, for example, latitude, longitude, altitude, geocode, course, direction, heading, speed, universal time (UTC), date, and/or various other information/data. In particular embodiments, the location module can acquire information/data, sometimes known as ephemeris information/data, by identifying the number of satellites in view and the relative positions of those satellites (e.g., using global positioning systems (GPS)). The satellites may be a variety of different satellites, including Low Earth Orbit (LEO) satellite systems, Department of Defense (DOD) satellite systems, the European Union Galileo positioning systems, the Chinese Compass navigation systems, Indian Regional Navigational satellite systems, and/or the like. This information/data can be collected using a variety of coordinate systems, such as the Decimal Degrees (DD); Degrees, Minutes, Seconds (DMS); Universal Transverse Mercator (UTM); Universal Polar Stereographic (UPS) coordinate systems; and/or the like. Alternatively, the location information can be determined by triangulating the computing entity's 10 position in connection with a variety of other systems, including cellular towers, Wi-Fi access points, and/or the like. Similarly, the computing entity 10 may include indoor positioning aspects, such as a location module adapted to acquire, for example, latitude, longitude, altitude, geocode, course, direction, heading, speed, time, date, and/or various other information/data. Some of the indoor systems may use various position or location technologies including RFID tags, indoor beacons or transmitters, Wi-Fi access points, cellular towers, nearby computing devices/entities (e.g., smartphones, laptops) and/or the like. For instance, such technologies may include the iBeacons, Gimbal proximity beacons, Bluetooth Low Energy (BLE) transmitters, NFC transmitters, and/or the like. These indoor positioning aspects can be used in a variety of settings to determine the location of someone or something to within inches or centimeters.

The computing entity 10 may also comprise a user interface (that can include a display 16 coupled to a processing element 08) and/or a user input interface (coupled to a processing element 08). For example, the user interface may be a user application, browser, user interface, and/or similar words used herein interchangeably executing on and/or accessible via the computing entity 10 to interact with and/or cause display of information from a logistics/carrier server(s), as described herein. The user input interface can comprise any of a number of devices or interfaces allowing the computing entity 10 to receive information/data, such as a keypad 18 (hard or soft), a touch display, voice/speech or motion interfaces, or other input device. In embodiments including a keypad 18, the keypad 18 can include (or cause display of) the conventional numeric (0-9) and related keys (#, *), and other keys used for operating the computing entity 10 and may include a full set of alphabetic keys or set of keys that may be activated to provide a full set of alphanumeric keys. In addition to providing input, the user input interface can be used, for example, to activate or deactivate certain functions, such as screen savers and/or sleep modes.

As shown in FIG. 7, the computing entity 10 may also include an camera, imaging device, and/or similar words used herein interchangeably 26 (e.g., still-image camera, video camera, IoT enabled camera, IoT module with a low resolution camera, a wireless enabled MCU, and/or the like) configured to capture images. The computing entity 10 may be configured to capture images via the onboard camera 26, and to store those imaging devices/cameras locally, such as in the volatile memory 22 and/or non-volatile memory 24. As discussed herein, the computing entity 10 may be further configured to match the captured image data with relevant location and/or time information captured via the location determining aspects to provide contextual information/data, such as a time-stamp, date-stamp, location-stamp, and/or the like to the image data reflective of the time, date, and/or location at which the image data was captured via the camera 26. The contextual data may be stored as a portion of the image (such that a visual representation of the image data includes the contextual data) and/or may be stored as metadata (e.g., data that describes other data, such as describing a payload) associated with the image data that may be accessible to various computing entities 10.

The computing entity 10 may include other input mechanisms, such as scanners (e.g., barcode scanners), microphones, accelerometers, RFID readers (or Near-Field Communication (NFC) readers), and/or the like configured to capture and store various information types for the computing entity 10. For example, a scanner may be used to capture parcel/item/shipment information/data from an item indicator disposed on a surface of a shipment or other item. In certain embodiments, the computing entity 10 may be configured to associate any captured input information/data, for example, via the onboard processing element 08. For example, scan data captured via a scanner may be associated with image data captured via the camera 26 such that the scan data is provided as contextual data associated with the image data.

The computing entity 10 can also include volatile storage or memory 22 and/or non-volatile storage or memory 24, which can be embedded and/or may be removable. For example, the non-volatile memory may be ROM, PROM, EPROM, EEPROM, flash memory, MMCs, SD memory cards, Memory Sticks, CBRAM, PRAM, FeRAM, NVRAM, MRAM, RRAM, SONOS, FJG RAM, Millipede memory, racetrack memory, and/or the like. The volatile memory may be RAM, DRAM, SRAM, FPM DRAM, EDO DRAM, SDRAM, DDR SDRAM, DDR2 SDRAM, DDR3 SDRAM, RDRAM, TTRAM, T-RAM, Z-RAM, RIMM, DIMM, SIMM, VRAM, cache memory, register memory, and/or the like. The volatile and non-volatile storage or memory can store databases, database instances, database management systems, information/data, applications, programs, program modules, scripts, source code, object code, byte code, compiled code, interpreted code, machine code, executable instructions, and/or the like to implement the functions of the computing entity 10. As indicated, this may include a user application that is resident on the entity or accessible through a browser or other user interface for communicating with the logistics server(s) and/or various other computing entities.

DEFINITIONS

"And/or" is the inclusive disjunction, also known as the logical disjunction and commonly known as the "inclusive or." For example, the phrase "A, B, and/or C," means that at least one of A or B or C is true; and "A, B, and/or C" is only false if each of A and B and C is false.

A "set of" items means there exists one or more items; there must exist at least one item, but there can also be two, three, or more items. A "subset of" items means there exists one or more items within a grouping of items that contain a common characteristic.

A "plurality of" items means there exists more than one item; there must exist at least two items, but there can also be three, four, or more items.

"Includes" and any variants (e.g., including, include, etc.) means, unless explicitly noted otherwise, "Includes, but is not necessarily limited to."

A "user" or a "subscriber" includes, but is not necessarily limited to: (i) a single individual human; (ii) an artificial intelligence entity with sufficient intelligence to act in the place of a single individual human or more than one human; (iii) a business entity for which actions are being taken by a single individual human or more than one human; and/or (iv) a combination of any one or more related "users" or "subscribers" acting as a single "user" or "subscriber."

The terms "receive," "provide," "send," "input," "output," and "report" should not be taken to indicate or imply, unless otherwise explicitly specified: (i) any particular degree of directness with respect to the relationship between an object and a subject; and/or (ii) a presence or absence of a set of intermediate components, intermediate actions, and/or things interposed between an object and a subject.

The terms first (e.g., first request), second (e.g., second request), etc. are not to be construed as denoting or implying order or time sequences unless expressly indicated otherwise. Rather, they are to be construed as distinguishing two or more elements. In some embodiments, the two or more elements, although distinguishable, have the same makeup. For example, a first memory and a second memory may indeed be two separate memories but they both may be RAM devices that have the same storage capacity (e.g., 4 GB).

The term "causing" or "cause" means that one or more systems (e.g., computing devices) and/or components (e.g., processors) may in in isolation or in combination with other systems and/or components bring about or help bring about a particular result or effect. For example, the logistics server(s) 105 may "cause" a message to be displayed to a computing entity 10 (e.g., via transmitting a message to the user device) and/or the same computing entity 10 may "cause" the same message to be displayed (e.g., via a processor that executes instructions and data in a display memory of the user device). Accordingly, one or both systems may in isolation or together "cause" the effect of displaying a message.

The term "real time" includes any time frame of sufficiently short duration as to provide reasonable response time for information processing as described. Additionally, the term "real time" includes what is commonly termed "near real time," generally any time frame of sufficiently short duration as to provide reasonable response time for on-demand information processing as described (e.g., within a portion of a second or within a few seconds). These terms, while difficult to precisely define, are well understood by those skilled in the art.

The term "coupled" to refers to two or more components being attached, fixed, or otherwise connected. Any suitable component can be used to couple components together, such as one or more: screws, bolts, nuts, hook fasteners, nails, etc.

The following embodiments represent exemplary aspects of concepts contemplated herein. Any one of the following embodiments may be combined in a multiple dependent manner to depend from one or more other clauses. Further, any combination of dependent embodiments (e.g., clauses that explicitly depend from a previous clause) may be combined while staying within the scope of aspects contemplated herein. The following clauses are exemplary in nature and are not limiting:

VI. CONCLUSION

Many modifications and other embodiments of the inventions set forth herein will come to mind to one skilled in the art to which these inventions pertain having the benefit of the teachings presented in the foregoing description and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation, unless described otherwise.

What is claimed is:

1. An item storage unit comprising:

a first frame component comprising a first side, a second side, a third side, and a fourth side that define a first aperture;

a first set of stretch members that is coupled to the first side and the second side, and partially covers the first aperture;

a second set of stretch members that is coupled to the third side and the fourth side, partially covers the first aperture, and is substantially perpendicular to the first set of stretch members;

a second frame component comprising a fifth side, a sixth side, a seventh side, and an eighth side that define a second aperture;

a third set of stretch members that is coupled to the fifth side and the sixth side, and partially covers the second aperture;

a fourth set of stretch members that is coupled to the seventh side and the eighth side, partially covers the second aperture, and is substantially perpendicular to the third set of stretch members; and a joint component coupled to the first frame component and the second frame component, wherein the joint component allows rotation of at least one of first frame component or the second frame component to situate an item between the first set of stretch members, the second set of stretch members, the third set of stretch members, and the fourth set of stretch members when the first frame component and the second frame component abut such that each stretch member of the first set of stretch members has a corresponding, substantially aligned stretch member of the third set of stretch members and each stretch member of the second set of stretch members has a corresponding, substantially aligned stretch member of the fourth set of stretch members.

2. The item storage unit of claim 1, wherein the second side includes a first lip, and wherein the fourth side includes a second lip that is separate from the first lip, wherein the first lip and the second lip are configured to be placed into respective slots of a holding apparatus such that the item storage unit is secured to the holding apparatus.

3. The item storage unit of claim 1, further comprising a tag embedded into the first frame component, the tag being configured to provide shipping information to a reader device.

4. The item storage unit of claim 1, further comprising an electronic ink display coupled to the first frame component, the electronic ink display displays electronic ink that contains at least one of: human-readable shipping information and a bar code associated with shipping information.

5. The item storage unit of claim 1, wherein the item storage unit and the item are what is shipped to a delivery destination as part of a final-mile logistics operation, wherein the item storage unit does not include a shipping label.

6. The item storage unit of claim 1, wherein the first set of stretch members, the second set of stretch members, the third set of stretch members, and the fourth set of stretch members include a transparent polymer-based material.

7. The item storage unit of claim 1, wherein the first frame component and the second frame component include a reclaimed polymer material.

8. The item storage unit of claim 1, wherein the first frame component is square or rectangular shaped.

9. The item storage unit of claim 1, further comprising a temperature sensor to measure an ambient outside temperature.

10. The item storage unit of claim 1, further comprising:

at least one of a gyroscope or an accelerometer configured to read an angular position of the item storage unit;

a speaker; and a processor configured to:

determine the angular position of the item storage unit satisfies a threshold; and responsive to determining the angular position of the item storage unit satisfies the threshold, send a control signal to the speaker to cause audio.

11. The item storage unit of claim 1, further comprising:

at least one of an accelerometer configured to read an acceleration of the item storage unit; and a processor configured to:

determine the acceleration satisfies a threshold; and responsive to determining the acceleration satisfies the threshold, send a notification to a remote device.

12. An item storage unit comprising:

a first frame component comprising a first side, a second side, a third side, and a fourth side defining a first aperture;

a first set of stretch members that is coupled to the first side and the second side, and partially covers the first aperture;

a second set of stretch members that is coupled to the third side and the fourth side, partially covers the first aperture, and is substantially perpendicular to the first set of stretch members; and a second frame component comprising a fifth side, a sixth side, a seventh side, and an eighth side defining a second aperture;

a third set of stretch members that is coupled to the fifth side and the sixth side, and partially covers the second aperture; and a fourth set of stretch members that is coupled to the seventh side and the eighth side, partially covers the second aperture, and is substantially perpendicular to the third set of stretch members, wherein when the first frame component is coupled to the second frame component to situate an item between the first set of stretch members, the second set of stretch members, the third set of stretch members, and the fourth set of stretch members, each stretch member of the first set of stretch members has a corresponding, substantially aligned stretch member of the third set of stretch members and each stretch member of the second set of stretch members has a corresponding, substantially aligned stretch member of the fourth set of stretch members.

13. The item storage unit of claim 12, wherein the second side includes a first lip, and wherein the fourth side includes a second lip, wherein the first lip and the second lip are configured to be placed into respective slots of a holding apparatus.

14. The item storage unit of claim 12, further comprising a tag embedded into the first frame component, the tag being configured to provide shipping information to a reader device.

15. The item storage unit of claim 12, further comprising an electronic ink display coupled to the first frame component, the electronic ink display displays electronic ink that contains at least one of: human-readable shipping information and a bar code associated with shipping information.

16. The item storage unit of claim 12, wherein the item storage unit and the item are what is shipped to a delivery destination as part of a final-mile logistics operation, wherein the item storage unit does not include a shipping label.

17. The item storage unit of claim 12, wherein the first set of stretch members includes a transparent polymer-based material.

18. The item storage unit of claim 12, wherein the first frame component includes a reclaimed polymer material.

19. The item storage unit of claim 12, further comprising:

at least one of a gyroscope or an accelerometer con figured to read an angular position of the item storage unit;

a speaker; and a processor configured to:

determine the angular positioning of the item storage unit satisfies a threshold; and responsive to determining the angular position of the item storage unit satisfies the threshold, send a control signal to the speaker to cause audio.

20. The item storage unit of claim 10, further comprising:

at least one of an accelerometer configured to read an acceleration of the item storage unit; and a processor configured to:

determine the acceleration satisfies a threshold; and responsive to determining the acceleration satisfies the threshold, send a notification to a remote device.

* * * * *